US010685620B2

(12) United States Patent
Plut

(10) Patent No.: US 10,685,620 B2
(45) Date of Patent: Jun. 16, 2020

(54) LUMINANCE SUPPRESSION POWER CONSERVATION

(71) Applicant: Samsung Electronics Co., Ltd., Suwon-si, Gyeonggi-do (KR)

(72) Inventor: William J. Plut, Los Altos, CA (US)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/200,009

(22) Filed: Nov. 26, 2018

(65) Prior Publication Data

US 2019/0096356 A1 Mar. 28, 2019

Related U.S. Application Data

(60) Continuation of application No. 12/577,493, filed on Oct. 12, 2009, now Pat. No. 10,140,945, which is a division of application No. 11/122,318, filed on May 4, 2005, now Pat. No. 7,602,408.

(51) Int. Cl.

| | |
|---|---|
| ***G09G 5/00*** | (2006.01) |
| *G09G 5/02* | (2006.01) |
| *G09G 3/20* | (2006.01) |

(52) U.S. Cl.

CPC ..... *G09G 5/00* (2013.01); *G09G 3/20* (2013.01); *G09G 5/024* (2013.01); *G09G 2330/021* (2013.01)

(58) Field of Classification Search

CPC ..... G09G 5/00; G09G 3/20; G09G 5/024; G09G 2330/021

See application file for complete search history.

(56) References Cited

U.S. PATENT DOCUMENTS

| | | | |
|---|---|---|---|
| 3,795,765 | A | 3/1974 | DeGroat et al. |
| 4,817,179 | A | 3/1989 | Buck |
| 4,952,917 | A | 8/1990 | Yabuuchi |
| 5,029,004 | A | 7/1991 | Shibayama |
| 5,270,818 | A | 12/1993 | Ottenstein |
| 5,359,345 | A | 10/1994 | Hunter |

(Continued)

FOREIGN PATENT DOCUMENTS

WO 03/091791 A1 11/2003

OTHER PUBLICATIONS

Hardening Windows Systems 2000, System Experts 2001, Philip Cox et al.

*Primary Examiner* — William Boddie
*Assistant Examiner* — Saifeldin E Elnafia
(74) *Attorney, Agent, or Firm* — Jefferson IP Law, LLP

(57) ABSTRACT

Described herein are systems and methods that reduce power consumption for an electronics device including a display. The systems and methods alter video information in a display area and reduce power for a display device when a graphics item is enlarged and the enlargement threatens to increase perceived luminance for the graphics item or increase aggregate luminance for the display area. Altering the video information reduces the luminance of video information in at least the graphics item when enlarged. This may offset perceived luminance gained by human visual processing when an item increases in size. If the graphics item is smaller than the display area after enlargement, then other video information in the display area may also be altered to conserve power.

20 Claims, 10 Drawing Sheets

(56) References Cited

U.S. PATENT DOCUMENTS 5,488,434 A 1/1996 Jung
5,524,249 A 6/1996 Suboh
5,572,655 A 11/1996 Tuljapurkar et al.
5,592,194 A 1/1997 Nishikawa
5,598,565 A 1/1997 Reinhardt
5,615,376 A 3/1997 Ranganathan
5,619,707 A 4/1997 Suboh
5,625,826 A 4/1997 Atkinson
5,642,125 A 6/1997 Silverstein et al.
5,675,364 A 10/1997 Stedman et al.
5,719,958 A 2/1998 Wober et al.
5,745,375 A 4/1998 Reinhardt et al.
5,781,768 A 7/1998 Jones, Jr.
5,796,382 A 8/1998 Beetson
5,796,391 A 8/1998 Chiu et al.
5,808,693 A 9/1998 Yamashita et al.
5,822,599 A 10/1998 Kidder et al.
5,880,728 A 3/1999 Yamaashi et al.
5,881,299 A 3/1999 Nomura et al.
5,914,751 A 6/1999 Korth
5,943,032 A 8/1999 Nagaoka et al.
5,956,014 A 9/1999 Kuriyama et al.
5,961,617 A 10/1999 Tsang
5,991,883 A 11/1999 Atkinson
6,026,179 A 2/2000 Brett
6,029,249 A 2/2000 Atkinson
6,031,914 A 2/2000 Tewfik et al.
6,043,853 A 3/2000 Shimazaki et al.
6,069,440 A 5/2000 Shimizu et al.
6,076,169 A 6/2000 Lee
6,100,859 A 8/2000 Kuriyama et al.
6,104,362 A 8/2000 Kuriyama et al.
6,111,559 A 8/2000 Motomura et al.
6,144,440 A 11/2000 Osgood
6,177,933 B1 1/2001 Young
6,177,946 B1 1/2001 Sinclair et al.
6,232,937 B1 5/2001 Jacobsen et al.
6,278,887 B1 8/2001 Son et al.
6,297,601 B1 10/2001 Kang
6,323,880 B1 11/2001 Yamada
6,345,364 B1 2/2002 Lee
6,356,284 B1 3/2002 Manduley et al.
6,362,835 B1 3/2002 Urbanus et al.
6,366,291 B1 4/2002 Taniguchi et al.
6,396,508 B1 5/2002 Noecker
6,396,520 B1 5/2002 Ording
6,408,293 B1 6/2002 Aggarwal et al.
6,411,306 B1 6/2002 Miller et al.
6,411,953 B1 6/2002 Ganapathy et al.
6,414,675 B1 7/2002 Shen
6,452,610 B1 9/2002 Reinhardt et al.
6,453,076 B1 9/2002 Nakajima
6,473,078 B1 10/2002 Ikonen et al.
6,473,532 B1 10/2002 Sheraizin et al.
6,496,165 B1 12/2002 Ide et al.
6,529,212 B2 3/2003 Miller et al.
6,552,736 B2 4/2003 Honda et al.
6,587,087 B1 7/2003 Ishizuka
6,606,103 B1 8/2003 Hamlet et al.
6,611,608 B1 8/2003 Wu et al.
6,621,489 B2 9/2003 Yanagisawa et al.
6,628,067 B2 9/2003 Kobayashi et al.
6,657,634 B1 12/2003 Sinclair et al.
6,661,029 B1 12/2003 Duggal
6,661,428 B1 12/2003 Kim
6,667,727 B1 12/2003 Iwaoka
6,677,924 B2 1/2004 Nakayama
6,677,936 B2 1/2004 Jacobsen et al.
6,683,605 B1 1/2004 Bi et al.
6,691,236 B1 2/2004 Atkinson
6,693,385 B2 2/2004 Koyama
6,701,263 B2 3/2004 Jeong
6,711,212 B1 3/2004 Lin
6,724,149 B2 4/2004 Komiya et al.
6,724,151 B2 4/2004 Yoo
6,731,815 B1 5/2004 Hu
6,744,818 B2 6/2004 Sheraizin et al.
6,762,741 B2 7/2004 Weindorf
6,768,520 B1 7/2004 Rilly et al.
6,774,878 B2 8/2004 Yoshida et al.
6,788,003 B2 9/2004 Inukai et al.
6,788,822 B1 9/2004 Zhang
6,791,566 B1 9/2004 Kuratomi et al.
6,801,811 B2 10/2004 Ranganathan et al.
6,809,706 B2 10/2004 Shimoda
6,812,650 B2 11/2004 Yasuda et al.
6,816,135 B2 11/2004 Ide et al.
6,819,036 B2 11/2004 Cok
6,822,631 B1 11/2004 Yatabe
6,829,005 B2 12/2004 Ferguson
6,839,048 B2 1/2005 Park
6,850,214 B2 2/2005 Nishitani et al.
6,900,798 B2 5/2005 Heie
6,912,664 B2 6/2005 Ranganathan et al.
6,938,176 B1 8/2005 Alben et al.
7,012,588 B2 3/2006 Siwinski
7,114,086 B2 9/2006 Mizyuabu et al.
7,301,522 B2 11/2007 Ko
7,312,771 B2 12/2007 Iwamura
7,389,432 B2 6/2008 Chandley et al.
7,400,314 B1 7/2008 Agano
7,432,897 B2 10/2008 Nishitani et al.
7,437,438 B2 10/2008 Mogul et al.
7,460,103 B2 12/2008 Konno et al.
7,463,235 B2 12/2008 Hiyama et al.
7,505,034 B2 3/2009 Nguyen
7,580,031 B2 8/2009 Plut
7,580,033 B2 8/2009 Plut
7,583,260 B2 9/2009 Plut
7,602,388 B2 10/2009 Plut
7,602,408 B2 10/2009 Plut
7,629,971 B2 12/2009 Plut
7,663,597 B2 2/2010 Plut
7,714,831 B2 5/2010 Plut
7,760,210 B2 7/2010 Plut
7,786,988 B2 8/2010 Plut
2001/0032321 A1 10/2001 Nanno et al.
2001/0033260 A1 10/2001 Nishitani et al.
2002/0047590 A1 4/2002 Kawano
2002/0063671 A1 5/2002 Knapp
2003/0071805 A1 4/2003 Stanley
2003/0179219 A1 9/2003 Nakano et al.
2003/0201969 A1 10/2003 Hiyama et al.
2004/0041780 A1 3/2004 Ko
2005/0253825 A1 11/2005 Kawamura et al.
2006/0020906 A1 1/2006 Plut
2006/0071899 A1 4/2006 Chang et al.
2006/0101293 A1* 5/2006 Chandley ..... G06F 1/3203
713/300
2006/0125745 A1 6/2006 Evanicky

* cited by examiner

LUMINANCE SUPPRESSION POWER CONSERVATION

CROSS-REFERENCE TO RELATED APPLICATION(S)

This application is a continuation application of prior application Ser. No. 12/577,493, filed on Oct. 12, 2009, which is a divisional application of prior application Ser. No. 11/122,318, filed on May 4, 2005, which has issued as U.S. Pat. No. 7,602,408 on Oct. 13, 2009, the disclosure of which is incorporated by reference herein in its entirety.

BACKGROUND

Field

This invention relates to systems and methods that provide power conservation for an electronics device. More particularly, the present invention relates to reducing power consumed by a display employed by the electronics device by suppressing luminance of video information output on the display device.

Description of the Related Art

Video output consumes a significant amount of power for a laptop or desktop computer. Other computing systems and electronics devices—such as handheld computing devices, cellular telephones and MP3 players—also devote a large fraction of their power budget to video. Power consumption sensitivity increases for portable devices relying on a battery that offers a limited energy supply.

Current power conservation techniques alter an entire image at once. Most techniques uniformly shut down a display or unvaryingly modify all video output in an image after some predetermined time, regardless of the video information presented. These techniques usually impede a person's ability to see graphics items and further use the computing device. Frequently, a person responds by reactivating the entire display—at full power. As a result, little power is saved.

Based on the foregoing, it should be apparent that alternative power conservation techniques would be desirable.

SUMMARY

The present invention provides systems and methods that reduce power consumption for an electronics device including a display. The systems and methods alter video information in a display area and reduce power for a display device when a graphics item is enlarged and the enlargement threatens to increase perceived luminance for the graphics item or increase aggregate luminance for the display area. Altering the video information reduces the luminance of video information in at least the graphics item, when enlarged.

According to the area affect of human visual processing, size of a graphics item on a display area will affect the perceived brightness of the graphics item and display area. An enlargement often increases perceived brightness of the graphics item. The enlargement may also contribute to an increase in total (or aggregate) luminance for the display area.

The alterations may then reduce luminance gained by perception when a graphics item increases in size. If the graphics item is smaller than the display area after enlargement, then other video information in the display area may also be altered to conserve power. As a result, perceived brightness of a graphics item or aggregate luminance of a display area may not significantly change when the graphics item enlarges, but power consumption may.

Aggregate luminance output over a display area may be used as a guide for video information alteration. In one embodiment, an initial aggregate luminance of the display area before any change serves as a comparator for luminance suppression, where new video information (such as an enlarging window) is altered so a new aggregate luminance for the display area does not exceed the initial aggregate luminance.

For ongoing power conservation, a reference aggregate luminance may also be set. In a steady luminance embodiment, changing video information is altered to maintain aggregate luminance about equal to the reference, e.g., within an error band, or less than the reference. Luminance may then be suppressed at or under the reference as user activity proceeds.

In one aspect, the present invention relates to a method for reducing power consumed by an electronics device that includes a display. The method comprises increasing size of a graphics item to create a larger graphics item. The method also comprises altering video information for at least a portion of the larger graphics item to produce an altered larger graphics item that includes a reduced luminance. The method further comprises displaying the altered video information. The display device consumes less power when displaying the altered larger graphics item than would be consumed for the larger graphics item without the video information alteration.

In another aspect, the present invention relates to a method for reducing power consumed by an electronics device. The method comprises displaying initial video information that contributes to an initial aggregate luminance output by the display device. In response to new video information for output on the display device, where the new video information will lead to a new aggregate luminance for the display device that is greater than the initial aggregate luminance, the method also comprises altering the new video information to produce altered video information that contributes to a reduced aggregate luminance for the display device that is less than the new aggregate luminance. The method further comprises displaying the altered video information.

In a luminance suppression aspect, the present invention relates to a method for reducing power consumed by an electronics device. The method comprises determining an aggregate luminance reference for output of video information by the display device. The method also comprises maintaining aggregate luminance output on the display device less than or about equal to the aggregate luminance reference by altering new video information for output on the display device.

In yet another aspect, the present invention relates to computer readable medium including instructions for reducing power consumed by an electronics device.

In still another aspect, the present invention relates to a system for reducing power consumed by an electronics device that includes a display device. The system includes a monitoring apparatus designed or configured to determine when a graphics item enlarges and display of the enlarged graphics item will increase aggregate luminance for a display area of the display device. The system also includes a power conservation apparatus designed or configured to alter video information included in the enlarged graphics item to produce altered video information. The altered video information contributes to a reduced luminance for the enlarged graphics item or a reduced aggregate luminance for the display device. The display device consumes less power when displaying the altered video information than would be consumed without the alteration.

These and other features of the present invention will be presented in more detail in the following detailed description of the invention and the associated figures.

DETAILED DESCRIPTION

Figure 1A:
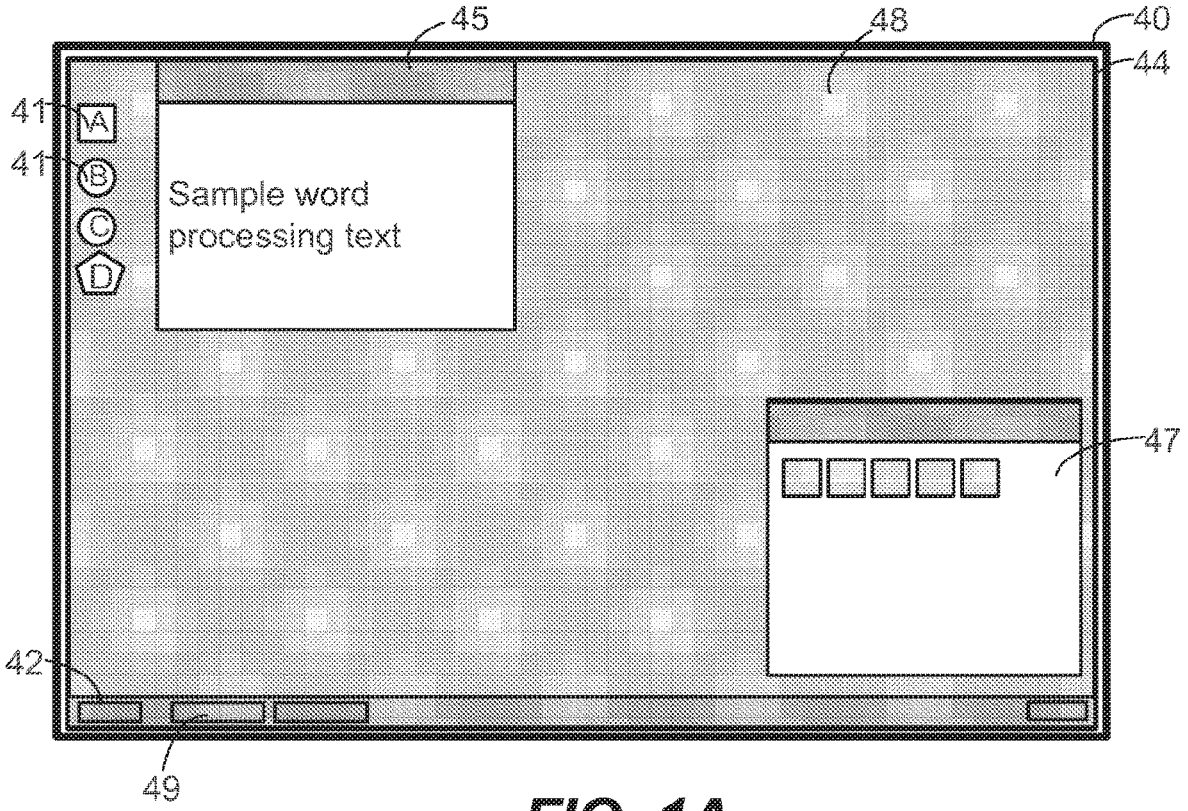
FIG. 1A illustrates video information output on a display device suitable for use with a laptop computer or desktop computer.

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Generally, human perception of visual information is a combination of the physical composition of a light beam (spectral composition, intensity, etc.), physiological processes in the human eye, physiological processes in the optic nerves as a consequence of light stimulus in the eye, and processing of these optic stimuli in the brain.

Human vision employs a number of processing and information reduction mechanisms that convert light and potentially tremendous amounts of ambient visual information into a manageable biochemical signal. The main information reduction mechanisms include: edge detection, shape detection, motion detection, and foreground/background separation. Foreground/background separation divides an environment to into a foreground where relatively more information is processed (e.g. allows more detail, such as looking closely at an insect in hand) and a background where less information is processed (e.g. provides less detail, such as the ambient room). Motion detection reduces detail for moving objects to allow motion processing (e.g., watching the insect fly through a room, albeit at lower detail than when in hand) Edge detection converts continuous color and luminance information or objects into lines (e.g., converting a uniform color square into four lines). Shape detection allows a person to recognize objects using lines, such as outer contours that resemble a shape for the object (e.g., a checkerboard based on its known arrangement of adjacent squares). While these mechanisms are useful to reduce the volume of information sent to the brain, they also create imperfections in visual perception.

One human vision imperfection relates to luminance processing. The eye handles a wide range of luminance: from starlight at about −2 log cd/m$^2$ to sunlight at about 5 log cd/m$^2$. The eye manages this wide range, albeit with some processing defects. For human vision, colors and images covering a large area tend to appear brighter than colors covering a smaller area. This is referred to as the 'area effect'. The effect is often encountered in selecting paint samples from a swatch. Selecting paint colors to be painted on a large wall using a small color sample having a small area often results in perceived errors. After looking at small samples and selecting a paint (color and luminance) that looks good, people sometimes find that the same color looks too bright when painted on the wall.

The present invention uses this imperfection in visual processing to alter video information and reduce power consumption by a display device. According to the area affect, size of a graphics item on a display area will affect the perceived brightness of the graphics item and display area. Thus, a graphics item with white information, such as a word processing window, having a smaller area will increase in perceived brightness when enlarged. The enlargement may also increase total (or aggregate) luminance for the display area, relative to what was present before the change.

The present invention alters video information in a display area and reduces power for a display device when a graphics item is enlarged and the enlargement threatens to increase luminance for the display device. Altering the video information reduces the brightness—or luminance—of the graphics item when enlarged. Thus, systems and methods described herein reduce luminance gained by perception when a graphics item increases in size. If the graphics item is smaller than the display area after enlargement, then other video information in the display area may also be altered to conserve power. Other changes in a graphics item that increase luminance may also be used as a trigger to alter luminance and conserve power. For example, luminance reductions and power conservation may also be performed when a program is initiated and a graphics item first appears (and threatens to increase aggregate luminance for the display).

In one embodiment, and according to the area affect, a person may not perceive a significant change in aggregate luminance of the display device before and after the enlargement, despite video alteration for the new graphics item. In this case, the person may also not visibly perceive power conservation.

Thus, perceived brightness of a graphics item or display area may not significantly change when the graphics item enlarges, but power consumption may. As will be described further below, OLED devices are current driven devices where electrical current flow to individual pixel elements varies with light output and the video information. Reducing luminance of the video information when the graphics item enlarges then reduces the amount of light and draws less current for each pixel. For many LCD devices, combined luminance at each pixel of the LCD is a combination of backlight level and transmissivity of the video information using pixilated filters. To reduce power, one may alter video information so as to reduce transmissivity to the point where a lower backlight level may be used when displaying lower luminance video information. Further description of hardware power consumption and conservation is described in further detail below.

Aggregate luminance is a term used herein to describe a sum of luminance for video information in a display area of a display device. In one embodiment, aggregate luminance for a display area is found by summing the luminance values for each pixel in the display area. An average luminance of all pixels in the display area may also characterize the aggregate luminance for a display area. Alternatively, aggregate luminance may relate to an upper end of a histogram for video information in the display area. One upper end example is where the aggregate luminance includes an average of the top x percent of luminance values in the display area, where x can range from about 2 to about 20 percent. Other mathematical expressions to define an aggregate luminance for a display area are also suitable for use with the present invention.

Aggregate luminance may then be used as a guide for video information alteration. In one embodiment, an initial aggregate luminance of the display area before any change acts as a comparator for luminance suppression, where new video information (such as an enlarging window) is altered so a new aggregate luminance for the display area does not exceed the initial aggregate luminance.

For ongoing power conservation, a reference aggregate luminance may also be set (e.g., according to user input). In another luminance suppression embodiment, changing video information is altered to maintain aggregate luminance for the display below the reference. In a steady luminance embodiment, changing video information is altered to maintain aggregate luminance about equal to the reference. As will be discussed below, the present invention also provides other techniques to manage aggregate luminance for a display area that reduce power consumption.

The present invention finds use with a wide array of display devices and electronics devices. For example, desktop and laptop computers with 12-17" display areas, measured diagonally, are now common and may benefit from techniques described herein. The present invention is particularly useful for portable electronics devices powered from a battery or other limited source of energy. Video conservation techniques described herein may significantly extend battery longevity and useable time for the portable device.

FIG. 1A illustrates video information output on a display device 40 suitable for use with a laptop computer or desktop computer. While the present invention will now be described as video information, graphics components and hardware components, those skilled in the art will recognize that the subsequent description may also illustrate methods and discrete actions for reducing power consumption for a display device and associated electronics device.

Display device 40 displays video information, and may include a liquid crystal display (LCD) device, projector, or an organic light emitting diode (OLED) device. Other display devices and technologies are suitable for use with the present invention.

Display device 40 outputs video information for a laptop or desktop computer within a display area 44. Display area 44 refers to a current image size of a display device. Pixel dimensions may characterize the size of display area 44. Physical dimensions (e.g., inches) that span an image produced by the display device may also characterize the size of display area 44. The display area 44 may be less than a maximum display area for the device, e.g., when a user manually alters horizontal and vertical expansion of a CRT image. Linear dimensions for display area 44 output by a projector will vary with the distance between the receiving surface and projector output lens and a splay angle for the projector. The physical dimensions may be measured on the projected image, usually after any keystone distortion has been suitably corrected for, which may also decrease the display area relative to the maximum display area. To facilitate discussion of LCD based power savings, device 40 will also be referred to as an LCD.

An electronics device, such as a desktop, laptop or handheld computer, often runs a graphics-based user interface 42. The graphics-based user interface 42 facilitates interaction between a user and the laptop computer and/or between the user and one or more programs run on the computer. Interface 42 also controls video information output on display device 40.

The video information refers to data for display to produce a visual representation of some form. The video information data is typically stored in a logical manner using values assigned to pixel locations, according to a pixel arrangement used for storing the data. Exemplary color schemes suitable for assigning values to video information are described below. The pixel arrangement may include a resolution that may or may not match a resolution for display device 40. For example, picture video information may be stored as a bitmap of a certain resolution for output on LCD 40.

Video information output on LCD 40 currently includes graphics items 45 and 47, icons 41 and background 48, as shown in FIG. 1A. In general, the present invention is not limited to any video information output on display device 40. Graphics items 41, 45, 47 and 48 are each for display as discrete visual objects and include video information related to a program stored and/or run on the computer. Popular programs include word processing programs, file navigation programs, Internet Browsers, drawing programs, music player programs, and video games, for example. Rectangular windows are common graphics items and may vary in size from a maximum size that roughly spans display area 44 to smaller sizes within display area 44. The rectangular windows may also be operated in minimized states where the program is active but the graphics item is not visible. A toggle 49 allows switching between these states, and triggering the toggle to a visible state may also threaten to increase luminance and initiate video alteration. For FIG. 1A, graphics item 45 includes a rectangular window that corresponds to a word processing program, while item 47 includes a window that corresponds to a file navigation program. Background 48 represents a backdrop graphics item for graphics-based user interface 42, and may include a picture, single color or other backdrop graphics. Icons 41 include initiation shortcuts to programs available to a user via the graphics-based user interface 42.

Display area 44 includes an initial aggregate luminance before any changes to video information included therein. Several techniques for quantifying an initial aggregate luminance were described above. The video information in each of graphics items 41, 45, 47 and 48 contributes to the initial aggregate luminance. The ratio of contribution will depend on the quantification tool used, the size of each graphics item, and the video information included in each graphics item.

Graphics items 41, 45, 47 and 48 may each include their own bitmap comprising an array of pixel values. This allows video alteration as described herein to occur separately on an individual graphics item, if desired.

Figure 1B:
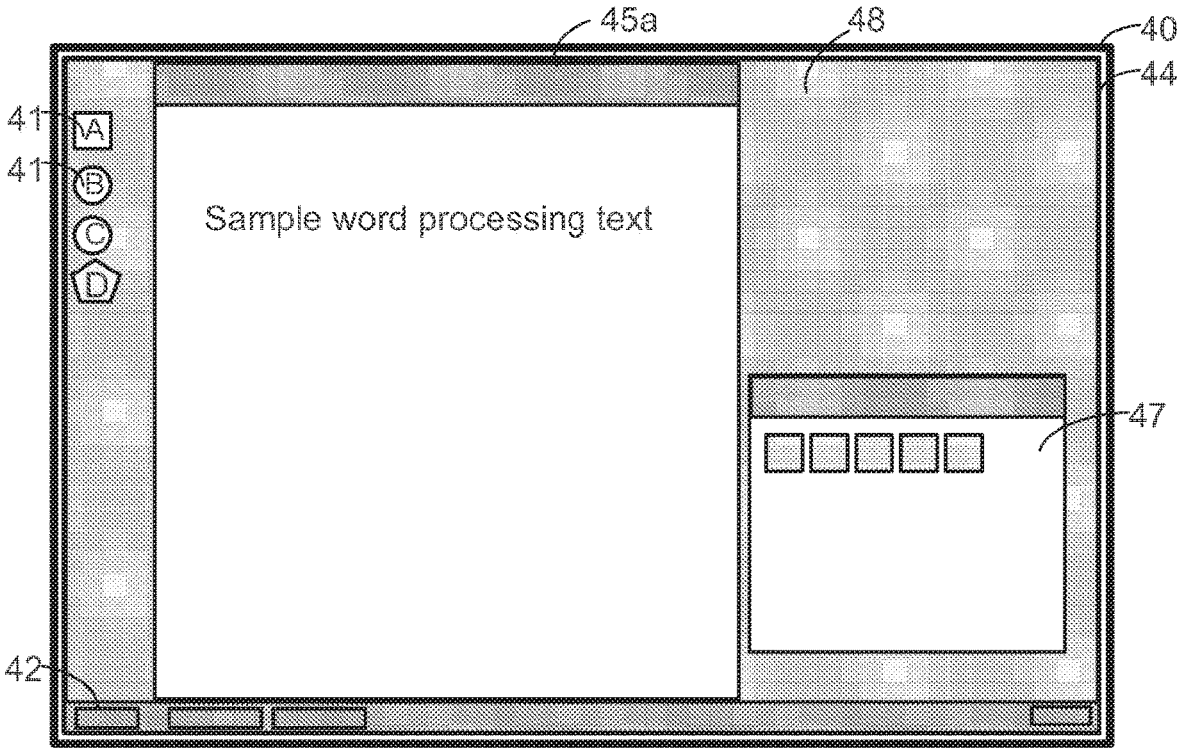
FIG. 1B illustrates the exemplary enlargement of a graphics item displayed on the display device of FIG. 1A.
Figure 1C:
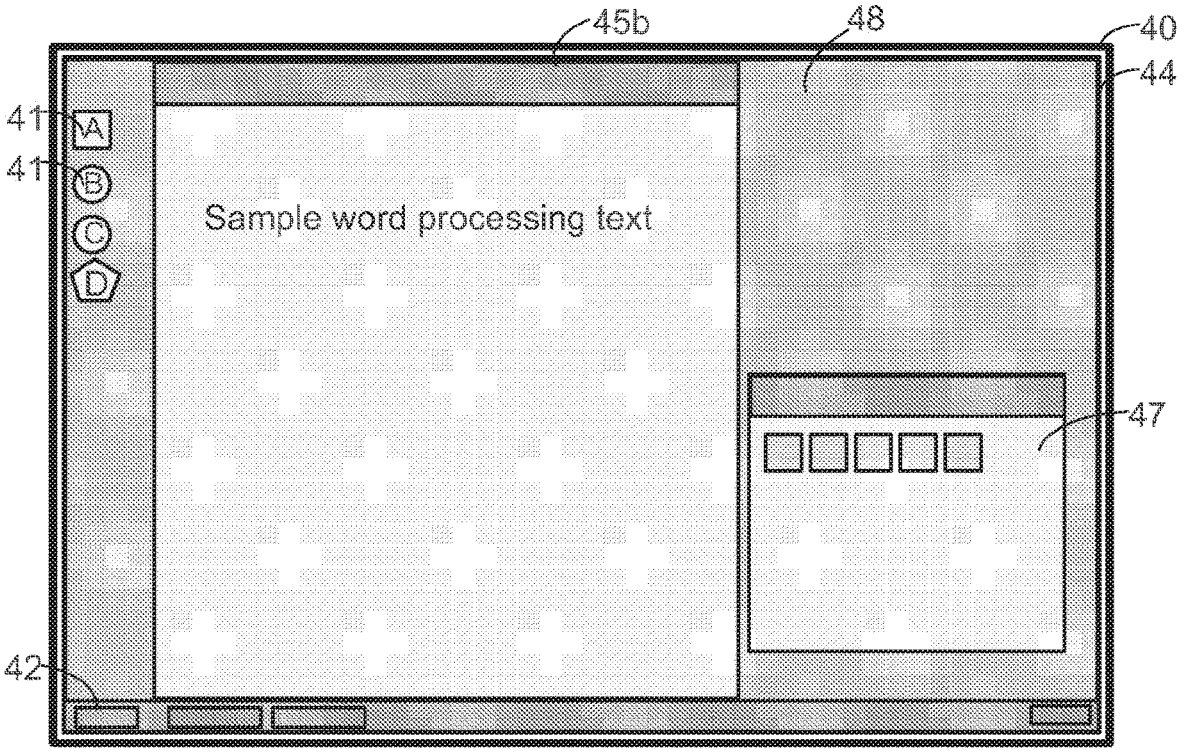
FIG. 1C illustrates video alteration and luminance reduction of the enlarged graphics item of FIG. 1B in accordance with a specific embodiment of the present invention.

FIG. 1B illustrates display device 40 with enlargement of graphics item 45 to produce an enlarged graphics item 45*a*. FIG. 1C illustrates video alteration and luminance reduction of the enlarged graphics item 45*b* in accordance with a specific embodiment of the present invention.

According to the area affect, a predominantly white window 45*a* increases perceived luminance of the window as it increases in size.

This enlargement will also potentially lead to a new aggregate luminance for the display device 40 that is greater than the initial aggregate luminance. The new aggregate luminance refers to the aggregate luminance caused by the change—before any power conserving video alterations are applied. The new aggregate luminance may be quantified using similar techniques used to quantify the initial aggregate luminance. In one embodiment, the larger size graphics item 45*a* is not displayed before a power conservation alteration is applied (FIG. 2B is not seen by a user).

In response to the change in size, and to reduce power consumption, the present invention alters video information for at least a portion of the larger graphics item 45*a*. This produces a reduced aggregate luminance for display area 44. As shown in FIG. 1C, luminance for central white (or off-white) portions of larger graphics item 45*a* are reduced to produce altered larger graphics item 45*b*, which contributes to the reduced aggregate luminance.

The amount of alteration may vary according to power conservation system design. At the least, the video information is altered such that the reduced aggregate luminance is less than the new aggregate luminance (that would have resulted from the enlargement without power conservation). In one embodiment, the video information is altered such that display area 44 provides a reduced aggregate luminance that is less than the initial aggregate luminance for area 44 before any enlargement of window 45.

In a steady luminance embodiment, the video information is altered such that the reduced aggregate luminance is about equal to the initial aggregate luminance. This steady luminance technique avoids producing an aggregate luminance change—or 'flicker'—resulting from a change in size for a graphics item. This may also avoid user perception of the luminance change, and thereby avoid perception of the power conservation.

Instead of aggregate luminance for the entire display area 44, the present invention may use a portion of the display area 44 as a luminance reference. In one embodiment, the luminance reference estimates luminance initially provided by a graphics item and uses this as a basis for comparison and power conservation. For example, aggregate luminance for graphics item 45 may remain at some initial or predetermined level as the user changes (increases and decreases) size of the word processing window. In this case, the present invention applies the area affect and power conservation only to the changing window. The predetermined aggregate may be input by a user or determined via power conservation control, at some reference size less than the display area 44. Aggregate luminance for the graphics item 45 may be dynamically determined using a sum of luminance values for all pixels in graphics item 45, or another aggregate luminance quantification tool described above. As window 45 size increases then, luminance decreases only for the window 45 and not other portions of display area 44. In a specific embodiment, video information for window 45 is altered such that luminance for the window 45 maintains a relatively constant level despite increasing size. This allows perceived luminance of the graphics item 45 to not significantly increase or change during size changes.

Power conservation system design may flexibly determine which video information is altered for a graphics item (or the entire display area). For FIG. 1C, only white video information for internal portions of graphics items 45 are altered. Since the internal white portion of larger graphics item 45*a* will assume a significant fraction of the new luminance for graphics item 45*b* and for the new aggregate luminance for display area 44 after enlargement, reducing the luminance of the white portions will significantly affect the new aggregate luminance for graphics item 45*b* and display area 44.

Power conservation system design may also alter other video information in display area 44. Altering all video information in display area 44 provides a simple option that is useful with LCD devices. Portions smaller than the entire display area 44 may include one or more graphics items, or any other suitable portions of a display area 44. For FIG. 1C, white portions in both the enlarged graphics item 45*b* and existing graphics item 47 are altered to reduce aggregate luminance and conserve power. Video information in icons and background 48, such as white clouds in a picture applied as background 48, may also be altered to contribute to the reduced aggregate luminance and power conservation. For an OLED device, each pixel affected will lead to power conservation.

Logic may be applied to determine which portions are altered. For example, the portions may correspond to video information that passes a certain logical threshold. In one embodiment, all video information in display area 44 with a luminance greater than the threshold is altered after enlargement to decrease aggregate luminance. A red, green and blue (RGB) threshold may be applied to the video data to determine which portions are altered.

For example, one logical filter may separate white portions of display area 44 for alteration. White is a very common color for a computer display; white areas are often encountered in a word processing file, drawing program, or a file navigation menu and may constitute more than half of display area 44. For OLED display devices, white video information also consumes more power than other shades and colors. To reduce power consumption by altering white information in portions of an image, video information for output on the display device is separated into white and non-white video information. This involves defining what constitutes white. For example, a user or power conservation system designer may designate any video information greater than some threshold (e.g., video information having RGB values greater than 245 for each primary color where the video information ranges from 0 to 255) to be white. Alternatively, the white threshold may comprise a specific shade of white. For example, the following shades of white are suitable for use: Snow White (255-250-250), Ghost White (248-248-255), Floral White (255-250-240), White Smoke (245-245-245), Old Lace (253-245-230), Linen (250-240-230), and Papaya White (255-239-213).

After a definition of white has been established, enlarging (or other) video information is filtered according to the white threshold, and video information identified as white is altered to reduce power consumption. As mentioned above, this may include white video information solely in the enlarged graphics item 45*a*, white video information in the entire display area 44, white video information solely in the portions of the display area 44 other than the enlarged graphics item 45*a* (e.g., background 48 and graphics item 47), or combinations thereof. For FIG. 1C, white video information in both graphics items 45*b* and 47 has been reduced to decrease aggregate luminance output by display device 40. As the term is used herein, 'white video information' refers to video information that has passed some threshold or criteria of whiteness. One of skill in the art will appreciate that there are thousands of shades of white.

The present invention advantageously permits a power conservation system designers and/or users to define a threshold—white or other—and thus specify what information is altered during enlargement of a graphics item 45 and potential luminance changes resulting therefrom.

Timing of the video alteration may vary. In one embodiment, video alteration occurs after input by a user that triggers the enlargement (e.g., enlarging the window or initiating a program for the window) but before the larger graphics item 45*a* becomes visible. In this case, a user does not see new aggregate luminance and FIG. 1B. For an enlarging window as shown from FIG. 1A to FIG. 1C, this allows luminance of the graphics item 45 or luminance output by the display device to remain relatively constant and not fluctuate from the initial level (FIG. 1A) to an increased aggregate luminance (FIG. 1B) and then back down to a reduced aggregate luminance after the alteration (FIG. 1C). This steady luminance may also reduce perception by a viewer of any changes in luminance.

The present invention decreases power consumption for device 40 by altering video information output on the LCD. As will be described below, the present invention alters video information such that LCD 40 can assume a lower backlight luminance level that consumes less power than the previous level. In one embodiment, video information is altered immediately upon an increase in size for graphics item 45. In this case, the present invention conserves power immediately and continually (as opposed to after some predetermined inactivity time). Graphics-based user interface 42 may also shut down the entire LCD 40 after some predetermined time of inactivity to further increase power conservation. However, power conservation according to the present invention has conserved significant power in the meantime.

Figure 1D:
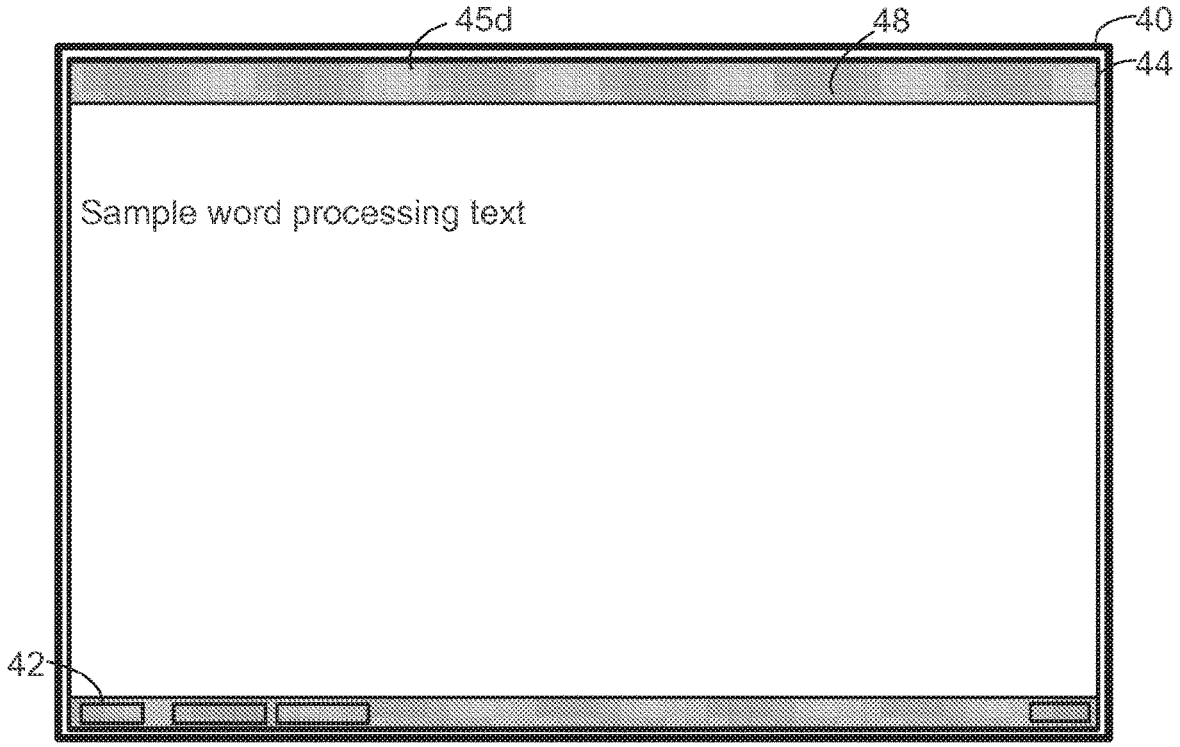
FIG. 1D illustrates full screen size enlargement of a graphics item displayed on the display device of FIG. 1A.
Figure 1E:
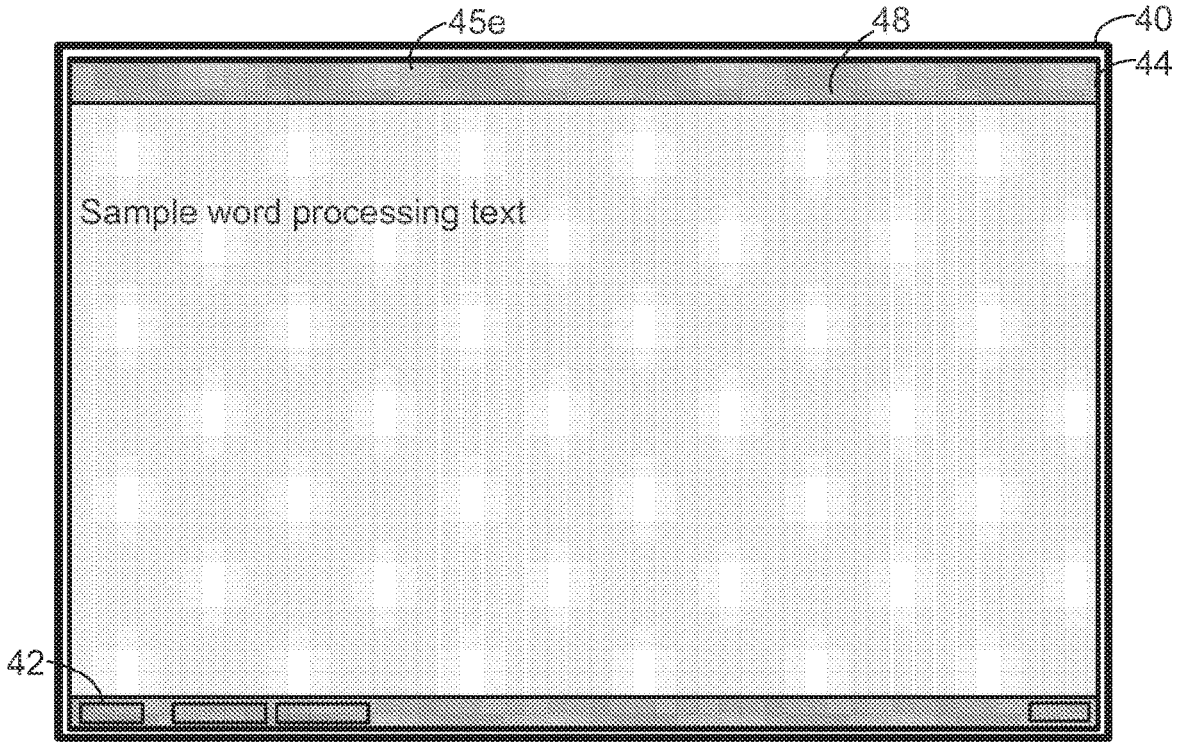
FIG. 1E illustrates video alteration and luminance reduction of the full sized graphics item of FIG. 1D in accordance with another specific embodiment of the present invention.

FIG. 1D illustrates display device 40 after enlargement of graphics item 45 (from FIG. 1A or FIG. 1C) to the full screen size of a display area 44. FIG. 1E illustrates video alteration and luminance reduction of the full sized graphics item 45*d* in accordance with another specific embodiment of the present invention.

This full screen enlargement will produce a new aggregate luminance for the display device 40 that is greater than the initial aggregate luminance. This enlargement will also lead to an increase in perceived luminance for the graphics item 45. In response to the change in size, the present invention alters video information for at least a portion of the full screen graphics item 45*d*. This produces an altered full screen graphics item 45*e*, a reduced aggregate luminance for display area 44, and diminishes the luminance of portions of graphics item 45. Since full screen graphics item 45*d* will dominate the new aggregate luminance for display area 44 after enlargement, reducing the luminance of the white portions (or any other portions of graphics item 45) will largely determine the new aggregate luminance for display area 44.

The reduced window luminance or aggregate luminance employed in an alteration may vary with design. For FIGS. 1C and 1E, the reduced window or aggregate luminance may depend on a number of factors including: the size of graphics item 45 before and after the enlargement, the video information in graphics item 45, other video information and graphics items in display area 44 (and their sizes), the size of display area 44, power conservation system aggressiveness, etc. For example, size of display area 44 will affect perceived brightness according to the area affect. LCD devices for desktop use including display areas over 17" and 19" are now common. Laptops offering 11"-15" diagonal display areas are widely available. In general, the larger the display area, the more gained by the area affect when maximizing size of a graphics items and the more aggressive video alterations and power conservation may be. Most of these factors are available to a power conservation system designer and may be accommodated for in system design to a) control aggregate luminance for any video information included on the display device, b) alter video information using aggregate luminance and video information contributing to the aggregate luminance, and c) tailor video alteration to achieve a desired level of power conservation. The power conservation may or may not be overly apparent to a user, depending on system design.

The present invention is not limited to any particular technique for reducing luminance in response to a change in video information. In general, video information alterations may include any changes to video information output on the display device that lead to perceived changes in brightness. In one embodiment, the present invention converts data to an HSL scheme and does video alteration in the luminance domain. Converting RGB video information to and from HSL video information provides a simple mechanism to implement luminance control. In a specific embodiment, the present invention sacrifices minor changes in color quality when altering video information to achieve aggregate luminance targets and tailor video changes. Generally, the human eye detects changes in luminance more readily than changes in color. While the human eye can differentiate about 10 million colors, this level of differentiation is usually achieved by making side-by-side comparisons. The human eye can only identify about 300 different colors from memory. Luminance and luminance differences are often more detectable, but vary with size of the image.

Figure 2A:
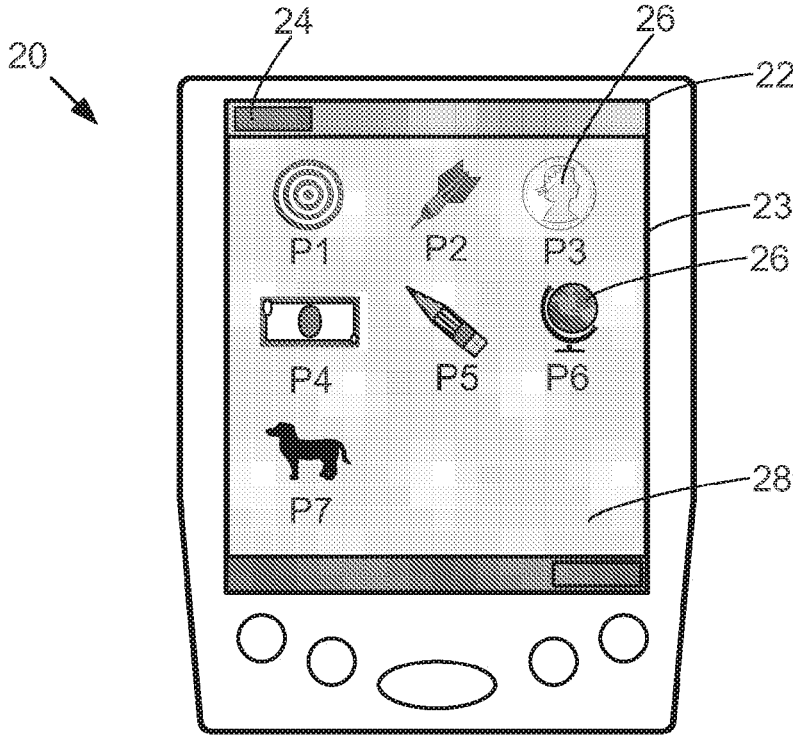
FIG. 2A illustrates an exemplary handheld computer device.
Figure 2B:
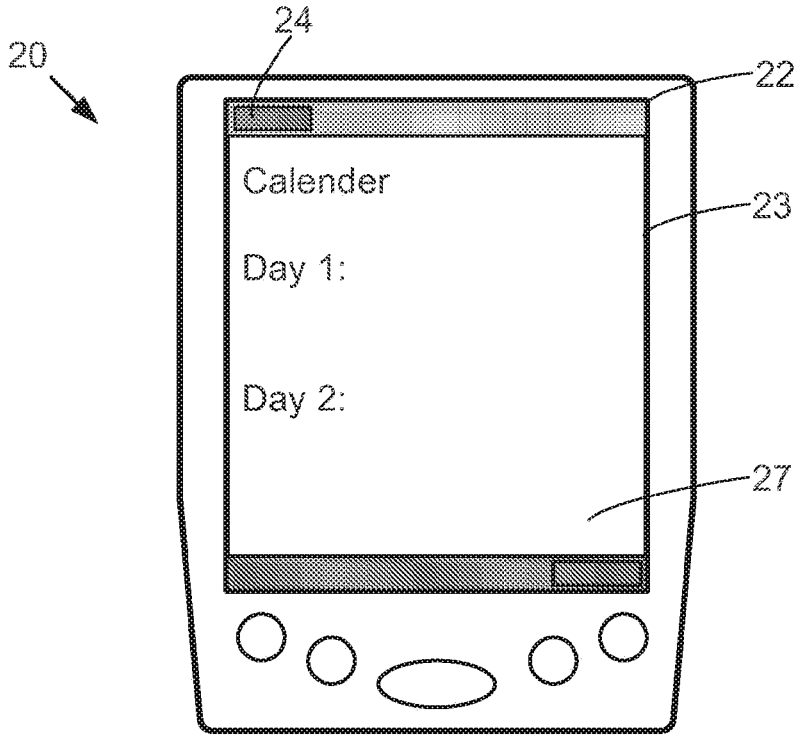
FIG. 2B illustrates the handheld device of FIG. 2A after initiation of a program that alters aggregate luminance output by a display device included in the handheld device.
Figure 2C:
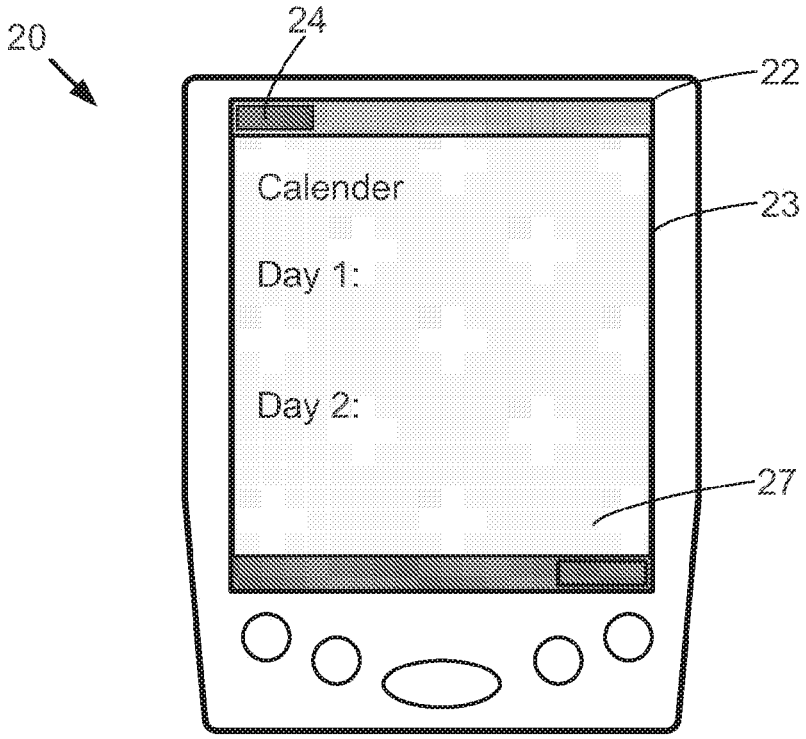
FIG. 2C illustrates the handheld device of FIG. 2B after alteration of video information for the program, which suppresses aggregate luminance for the display and reduces power consumption in accordance with a specific embodiment of the present invention.

FIG. 2A illustrates an exemplary handheld computer device 20. FIG. 2B illustrates handheld device 20 after initiation of a program 26 that overtakes video output in a display area 23 and alters aggregate luminance output by a display device 22 included in device 20. FIG. 2C illustrates handheld device 20 after alteration of video information for program 26, which suppresses aggregate luminance for the display 22 and reduces power consumption in accordance with a specific embodiment of the present invention.

Handheld computer device 20 includes a display device 22 that displays video information. Individual pixel locations within a display area 23 for device 22 permit allocation and addressing of video information displayed within display area 23. Pixel dimensions and resolution may characterize display area 23. For example, display device 22 may comprise an OLED display device that offers pixel dimensions of 480×640. The OLED device also permits video information changes for individual pixels to affect power consumption and conservation.

Handheld device 20 runs a graphics-based user interface 24 within display area 23. Interface 24 facilitates interaction between a user and device 20 and/or between the user and one or more programs run on computer device 20. To do so, interface 24 outputs video information on display device 20. As shown in FIG. 2A, interface 24 currently displays a background 28 and a set of icons 26 that each correspond to a program available on device 20. The icons 26 are displayed on background 28, which includes its own set of background video information and provides a backdrop environment for graphics-based user interface 24.

Handheld devices 20 differ in video presentation in that display area 23 is small enough such that a user typically only displays one program at a time. This allows power conservation system design to leverage video output alterations based on knowledge that a program 26 being displayed probably largely determines the majority of video output on display area 23.

FIG. 2A illustrates display area 23 before initiation of a program 26. An initial aggregate luminance for display area 23 is then determined by luminance contributions from the background 28 and icons 26.

FIG. 2B shows display area 23 after initiation of a calendar program 26, which mainly includes a white background 27 for the program and text. Display area 23 includes a new aggregate luminance that is greater than the initial aggregate luminance.

FIG. 2C illustrates display area 23 after alteration of video information in program 26 in accordance with a specific embodiment. In this case, only white portions, such as those in background 27, are altered to reduce aggregate luminance and conserve power. In another embodiment, all video information in display area 23 is reduced in luminance.

Notably, the present invention conserves power without substantially compromising usability of electronics device 20. More specifically, the video information is altered such that the person may still detect video information included in display area 23. Thus, a user may still read text and perceive other visual information relevant for interaction after video information has been altered. As shown, a user may still perceive and read text included in a calendar or word processing program (e.g., black letters) while white information in the program is minimally altered to an off-white state.

While FIGS. 1 and 2 illustrate two specific electronics devices, power conservation techniques described herein are also well suited for use with other electronics devices. Other exemplary devices include cellular telephones, portable music players, digital cameras, and other portable computing and electronics devices.

Having discussed exemplary electronics devices and display devices, video information representation and power conservation will now be described in further detail.

Red, green, blue (RGB) color schemes are popular and suitable to characterize video information according to combinations of red, green and blue values. Video information is often stored according to an RGB scheme. In many RGB based display devices, individual optical modulation elements receive commands for video output that include RGB values between 0 and 255 to produce a desired video output for a pixel. For example, one greenish color may comprise red/green/blue values of 45/251/62.

OLED display devices include a red, green, and blue individual light emitting diode or filter for each pixel. For an OLED display 22 included in handheld computer 20, the amount of current sent to an individual light emitting diode or filter increases with each RGB color level between 0 and 255. Decreasing the RGB levels then reduces the amount of power for each diode and pixel. More specifically, altering white video information RGB values of 240/245/227 to 235/235/235 reduces the amount of current sent to each individual light emitting diode for each pixel that emits the white color. The amount of power conserved for an OLED display device can then be determined by summing the power saved for all pixels in the display area that have been altered.

Figure 3:
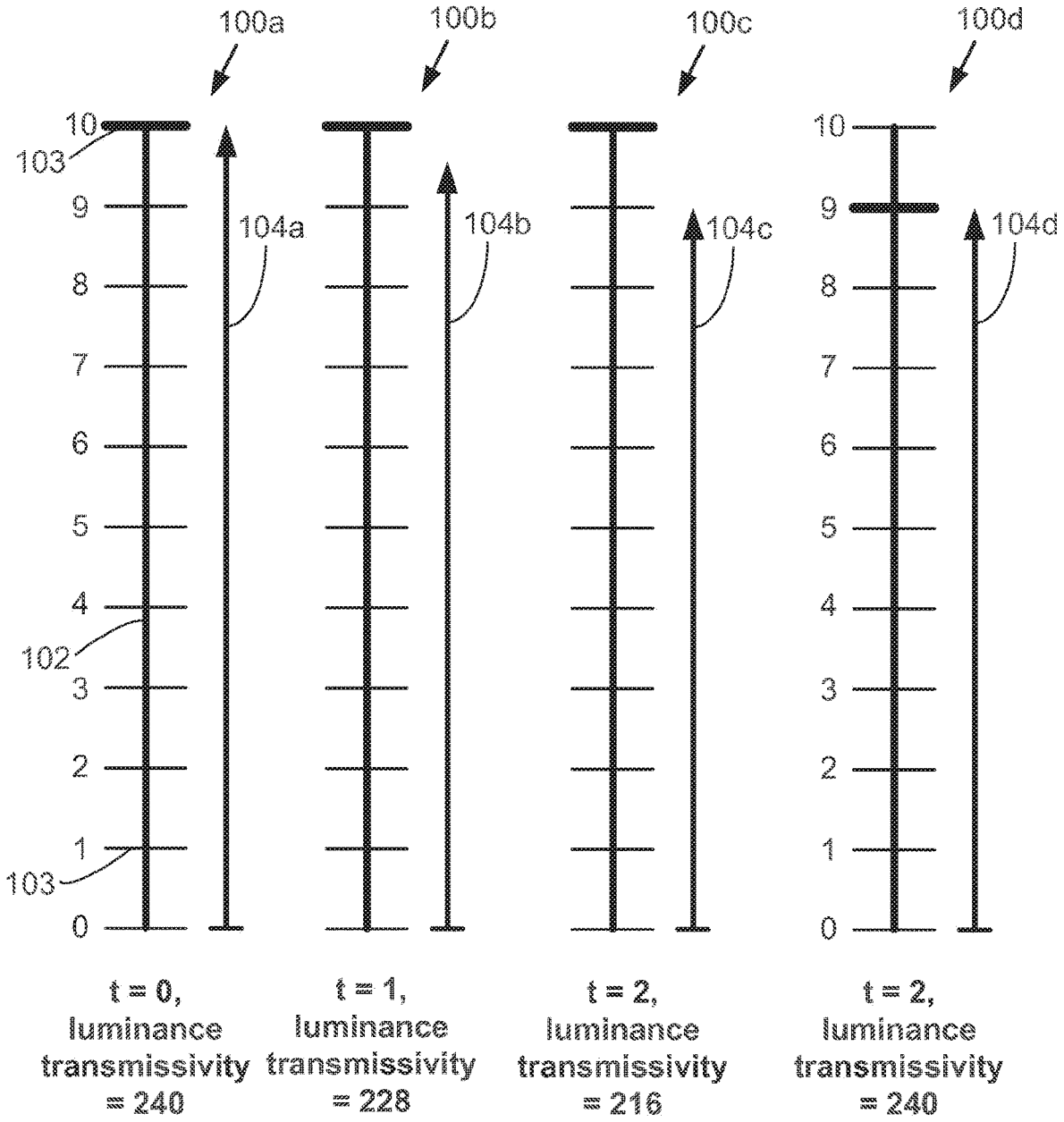
FIG. 3 shows video information alteration for an exemplary pixel in accordance with one embodiment of the present invention.

LCD devices provide two degrees of freedom for controlling luminance: 1) different luminance levels provided a backlight and 2) graduated filtering by optical modulation elements for each pixel. FIG. 3 shows video information alteration for an exemplary pixel for an LCD device. Four luminance states 100*a-d* are shown at three different times: t=0, t=1 and t=2.

Scale 102 illustrates a number of backlight luminance levels 103 offered by a backlight used in an LCD device. As shown, the LCD provides ten discrete backlight levels 103, numbered from 0 to 10, where 0 is off and 10 represents the maximum luminance for the backlight. In this simplified example, each increasing integer luminance level between 0 and 10 provides a proportionate increasing luminance (each level represents about 10% the maximum luminance) for the backlight. More complicated backlight levels are contemplated and suitable for use.

Transmissivity refers to the amount of light passage provided by optical modulation elements for a pixel. Many LCD devices include red green and blue (RGB) filters that act as optical modulation elements, where each filter regulates passage of white light produced by the backlight through a colored filter element to produce red, green and blue light, respectively. Transmissivity may then be expressed using RGB values sent on control signals to each RGB filter. LCD devices including modulation elements that respond to RGB transmissivity values ranging from 0 to 255 are common. The video information and transmissivity may also be expressed and converted to and from another video data scheme. An HSL color scheme characterizes video output according to a wavelength or color (hue), degree of purity of the color (saturation), and degree of brightness for the color ranging from black to white (luminance). Transmissivity may also then be expressed in HSL luminance. For example, luminance may be provided at integers between 0 and 240, where zero represents black (full filtering and blocking of light provided by the backlight) and 240 represents white (no filtering and blocking of light provided by the backlight).

As the term is used herein, 'combined luminance' refers to a luminance perceived by a viewer of an LCD device.

This combined luminance combines luminance effects provided by a) the backlight and b) filtering provided by the optical modulation elements for each pixel. The combined luminance is typically limited to a maximum determined by the backlight level since the pixelated filters only reduce light currently offered by the backlight. For FIG. 3, maximum luminance for the LCD device corresponds to a backlight level of 10 and luminance transmissivity of 240. At backlight luminance level 9, the maximum aggregate luminance for video data corresponds to a luminance transmissivity of 240 (t=3). Combined luminance for the pixel is designated as 104*a-d* for FIG. 3 at each time instance.

Both the backlight level and the luminance transmissivity are controllable. LCD power conservation leverages the two degrees of freedom in luminance control to reduce power for the LCD device.

At time t=0, the illustrated high luminance pixel (a white pixel) includes a backlight level of 10 and luminance transmissivity of 240, which corresponds to a maximum for the aggregate luminance and is designated as 104*a*.

The present invention alters video information for the pixel. This may reduce transmissivity and luminance for the pixel and/or the backlight level. For the example at time t=1, the backlight level remains at level 10 but the video information is altered to reduce the luminance transmissivity to 228. This provides a combined luminance of 104*b* (a less white shade). In this case, information has been altered but without a backlight change, and no power conservation has been achieved.

At time t=2, the backlight level still remains at level 10 but the video information is altered to reduce the luminance transmissivity to 224 (an even less white shade). This provides a combined luminance of 104*c*. Combined luminance of 104*c* is noteworthy because it approximately corresponds to the combined luminance of 104*d* provided by the LCD device for the pixel when the backlight level drops to level 9 and the luminance transmissivity returns to 240 (its original level). At this luminance, the backlight level may drop from level 10 to level 9 and the luminance transmissivity increases from 224 to 240—without changing the combined luminance of 104 as perceived by a viewer. Power consumption for the backlight and LCD device reduces when the backlight level changes from level 10 to level 9.

Although the above example has been simplified to illustrate two degree of freedom luminance control and power conservation using and LCD, the present invention is not limited to such simple expressions of backlit luminance levels and pixel transmissivity. The above example employed ten backlight luminance levels; other numbers of backlight luminance levels are contemplated. In general, the LCD device may include any number of backlight luminance levels. As the granularity of backlit luminance levels increases, so does power conservation and the ability to more readily use a lower backlight level. The backlight luminance levels also need not correspond to simple fractions of the maximum luminance or integer levels as described above. In addition, luminance transmissivity is not limited to expression using a range of 1-240. Other luminance transmissivity and color schemes, such as normalized scales, are also suitable for use. As one of skill in the art will appreciate, the number and characterization of backlight luminance levels will depend on the LCD used, while the number and characterization of video information will depend on the video scheme used to represent the video data.

Combined luminance thus allows a designer to relate backlight luminance levels and pixel transmissivity for an LCD device, which permits a designer to alter the video information and point the modifications towards backlight luminance reductions. A combined luminance model may be built for a device that estimates luminance perceived by a user as a combination of backlight and pixilated transmissivity. For example, the combined luminance may be used to provide a ratio (or another suitable mathematical relationship) between the backlight luminance levels and pixel transmissivity.

Although the present invention has so far referred to alteration of video information for graphics items and single pixels, it is understood that an image will include an array of video information and luminance values. A histogram describes the frequency of pixel values (e.g., luminance or chroma) for an image.

One embodiment of the invention sets a high luminance limit for the histogram after an alteration. The high luminance limit refers to a reference luminance level for the video information that may be used to guide alteration, e.g., before changing a backlight luminance on an LCD device. Typically, the high luminance limit is near an upper limit of the luminance values in the image histogram. In a specific embodiment, the high luminance limit is the maximum luminance for the video information, and the maximum is altered to produce a new maximum luminance for the altered video information that is less than the largest available luminance at the next backlight level. This allows\luminance for any pixel in the image to remain relatively constant (or produce little perceptible change) at the moment of backlight level change.

Having discussed exemplary power reduction techniques and electronics devices, power conservation implementation will now be described in further detail.

Figure 4A:
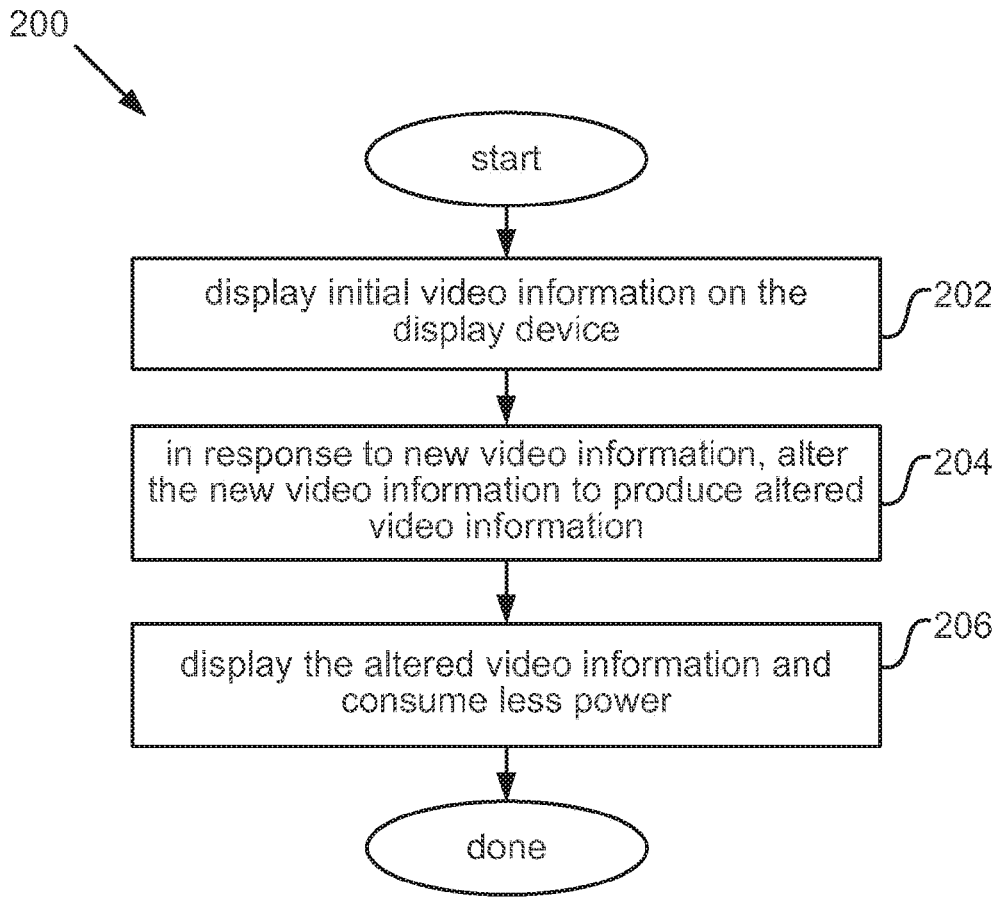
FIG. 4A illustrates a process flow for reducing power consumed by an electronics device in accordance with one embodiment of the invention.

FIG. 4A illustrates a process flow 200 for reducing power consumed by an electronics device in accordance with one embodiment of the invention. While the present invention will now be described as a method and separable actions for reducing power consumption, those skilled in the art will recognize that the subsequent description may also illustrate hardware and/or software systems and items capable of performing the method and actions.

Process flow 200 begins by displaying initial video information (202) that contributes to an initial aggregate luminance output by a display device. The video information includes any information output in a display area. This may include graphics items and other video information output by a program or electronics device to a user. For example, a graphics item may be displayed on the display device at a small size when a computer or program is first started or during active usage when a user is interacting with the electronics device.

User activity on the display device may include various actions that potentially decrease and potentially increase luminance, such as decreasing or increasing size of the graphics item. As mentioned above, triggering a toggle that activates a program to a visible state may also threaten to increase luminance and initiate video alteration. In addition, initiating a graphics item may include initiating a program corresponding to the graphics item. Regardless of the specific event, at some point, and in response to new video information for output on the display device that will lead to a new aggregate luminance for the display device that is greater than the initial aggregate luminance, process flow 200 alters the new video information to produce altered video information (204). The altered video information contributes to a reduced aggregate luminance for the display device that is less than the new aggregate luminance.

Aggregate luminance output by the display device may be used as a reference for alteration. In one embodiment, a reduced aggregate luminance for the altered video information is less than the initial aggregate luminance for the original video. In another embodiment, the reduced aggregate luminance is about equal to, or within a predetermined error band of, the initial aggregate luminance. This steady luminance technique reduces user perception to any luminance changes and power conservation.

The video information is altered such that the display device consumes less power after the alteration. More specifically, the display device consumes less power when displaying the altered video information than would be consumed for display of the new video information. For an OLED device, this usually includes reducing one or more RGB values for the pixilated video information. Alteration may also include reducing transmissivity and luminance of video information to generate a new high luminance that is less than or about equal to a second backlight luminance level offered by the backlight. Conversion between RGB and HSL allows changes to be readily implemented using luminance values. This also maintains hue and saturation, although the present invention also works well with altering these if desired.

The altered video information is then output to the display device and displayed (206).

Figure 4B:
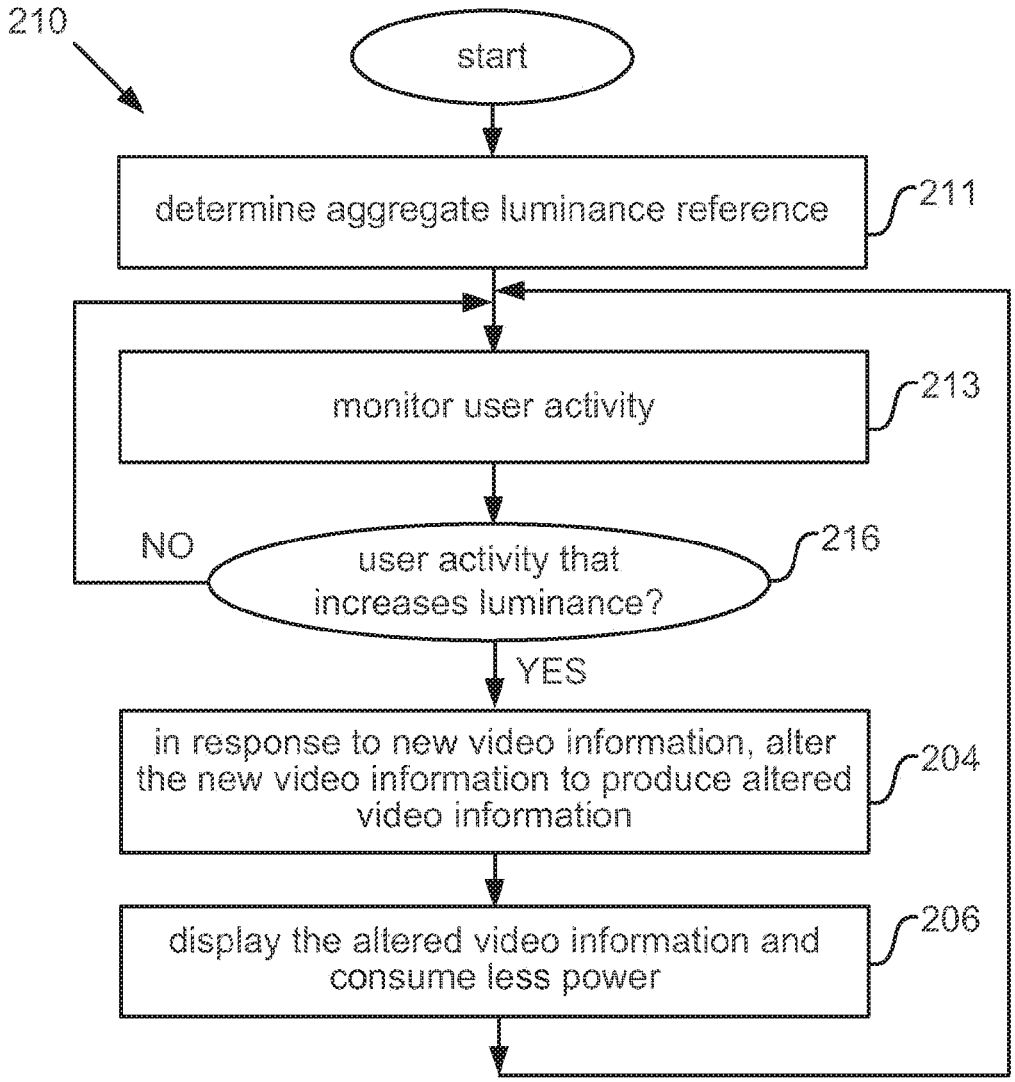
FIG. 4B illustrates a process flow for reducing power consumed by a display device in accordance with another embodiment of the invention.

The present invention also allows a power conservation designer to set an aggregate luminance reference. The reference then acts as an upper limit for luminance output on the display device. When new video information threatens to include a new aggregate luminance that is greater than the reference, then the video information is altered to maintain the upper reference. FIG. 4B illustrates a process flow 210 for reducing power consumed by a display device in accordance with this embodiment of the invention.

Process flow 210 begins by determine aggregate luminance reference for output of video on a display device (211). A power system designer may set this luminance reference, for example. Alternatively, a user may implement the luminance reference when setting a power conservation scheme. A power scheme refers to a collection of power options that dictate how and when video information is altered to reduce power consumption. In one embodiment, a power conservation system is stored on a computer and implements a power conservation scheme without user input. In another embodiment, a graphics control, which opens in a separate window upon initiation, allows a user to set a power scheme or one or more power options corresponding to techniques described herein. Parameters set by a user may include the aggregate luminance reference, a luminance reference for graphics items such as white windows, trigger events, suppression for certain programs (such as movie players), specific histogram techniques used, other power conservation parameters described herein, etc.

After the reference has been established, process flow 210 monitors user activity and video output within the display area (213). Process flow 210 continues to monitor activity over time and reacts according to any user activity that threatens to increase luminance in the display area (216). If user activity occurs in the display area that will increase luminance, process flow 210 then alters video information (204). This maintains aggregate luminance output on the display device less than or about equal to the aggregate luminance reference.

In a steady luminance embodiment, process flow 210 uses the reference to maintain aggregate luminance about the reference as the video information changes. An error band of the reference may also be employed, where the reduced aggregate luminance after alteration is within a predetermined error of the reference.

In another embodiment, a luminance reference is set for a graphics items such as a white window, typically at some predetermined size. Increases in size above this predetermined size may then reduce luminance for the graphics item, while decreases in size relative to the predetermined size may increase luminance. This maintains steady luminance for the graphics item.

The altered video information is then output to the display device and displayed (206). The reduced aggregate luminance caused by the alteration consumes less power for the display device than would be consumed without the video information alteration.

Figure 5A:
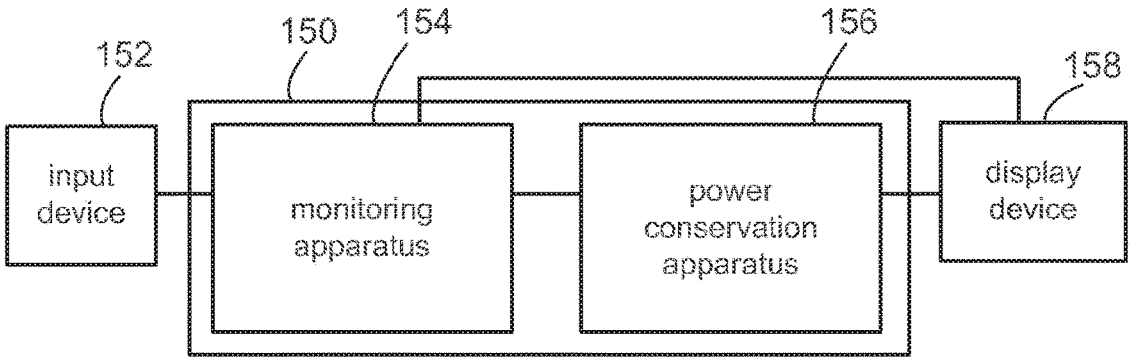
FIG. 5A illustrates a system for reducing power consumed by a display device in accordance with one embodiment of the present invention.

The present invention also relates to systems for conserving power for an electronics device or display device. FIG. 5A illustrates a system 150 for reducing power consumed by a display device 158 in accordance with one embodiment of the present invention. While the present invention will now be described as an apparatus composed of units, those skilled in the area will recognize that the present invention encompasses a method, process or software having as steps the actions performed by each unit and described below.

System 150 comprises monitoring apparatus 154 and power conservation apparatus 156. In general, system 150 may comprise any combination of software and hardware for carrying out actions described herein. In one embodiment, monitoring apparatus 154 and power conservation apparatus 156 are implemented solely in software stored on a computer and run by a processor (such as a video or graphics chip or main processor). In another embodiment, general-purpose computer processing units, instead of dedicated hardware, implement the monitoring and video alteration techniques described herein.

Coupled to system 150 are input device 152 and display device 158. Input device 152 allows a user to position a pointer within a display area of display device 158. Some popular input devices include a mouse, a position-sensing pad on a laptop computer, a stylus working in cooperation with a position-sensing display on a PDA, a positioning knob included on a keyboard of a laptop computer, one or more arrow keyboard keys, one or more buttons on a PDA, etc.

Monitoring apparatus 154 is designed or configured to monitor user activity in a display area for display device 158. In particular, monitoring apparatus 154 determines when a graphics item enlarges and display of the enlarged graphics item will increase aggregate luminance for a display area of the display device. To do so, monitoring apparatus 154 observes video activity on display device 158 and notes when video information changes. Monitoring apparatus 154 may also maintain or access a register of aggregate luminance references, or calculate aggregate luminances based on user activity. Events that apparatus 154 may detect include when a graphics item enlarges, when a program is initiated, when a program is toggled from inactive status, or any other event that threatens to increase luminance on the display.

Monitoring apparatus 154 may also process digital information from input device 152 that describes spatial input from a user and is configured to access digital representations of spatial areas for individual graphics items in the display area. Monitoring apparatus 154 then compares digital information from input from device 152 and the digital representations, and characterizes the user activity. On one or more output lines, monitoring apparatus may output user activity information including: a) aggregate luminance for one or more graphics items, b) aggregate luminance for the display area, and c) temporal information related to user activity, such as an amount of time that an image has maintained an active or inactive status.

Power conservation apparatus 156 is designed or configured to alter video information included in an enlarged graphics item. This produces altered video information and contributes to a reduced luminance for the enlarged graphics item or a reduced aggregate luminance for the display device. Several suitable techniques that reduce power consumption for display device 158 based on video information alterations were discussed above. Power conservation apparatus 156 outputs the altered video information to display device 158. While apparatus 156 has been described as a discrete device, those skilled in the art will realize that apparatus 156 may include software that outputs a control signal useful for altering video information.

Display device 158 displays video information. In one embodiment, display device 158 outputs video information onto a screen including array of individually addressable pixels. Display device 158 receives the altered video information from power conservation apparatus 56, or a buffer included in or associated with apparatus 156, and displays the altered video information.

Display device 158 varies its power consumption with video output. In one embodiment, display device 158 varies power consumption with the spatial distribution of light output in a display area. One such display device 158 employs organic light emitting diodes (OLED) for video output. OLED displays are current driven devices where the intensity of light output from an OLED display is proportional to electrical current. Power output for an OLED device spatially varies by controlling and modulating electrical current levels for individual light elements that are arranged for each pixel. For a color display, each pixel usually comprises three OLED light element assemblies: one for red light, a second for blue light, a third for green light. Each assembly produces a color of light directly or uses a colored filter, and RGB values are produced according to current input proportional to an RGB value, such as from 0 to 255 or normalized in a range from 0 to 1. Reducing RGB values for individual pixels—such as reducing RGB values for altered white video information as described herein—reduces power consumption for each assembly and each pixel. Cumulatively, this reduces current and power requirements for the entire OLED display device based on summations of all pixels whose power has been reduced. OLED displays are becoming increasingly popular for portable and battery powered devices, making power conservation techniques described herein particularly useful to conserve power when supply is limited.

In another embodiment, display device 158 comprises a backlit LCD screen. For many LCD devices, power consumption is proportional to luminance for the backlight and the LCD comprises a set of controllable luminance levels (e.g., from 1-10) that each increasingly generates more light and consumes more power. LCD displays for many handheld devices include relatively less stepwise luminance levels (e.g., less than 10), while LCD displays for many laptop computers include more stepwise luminance levels (e.g., 10 or more). In general, the present invention is suitable for use with any LCD device not limited to any particular LCD design. In one embodiment, LCD 158 includes a backlit LCD screen that varies power consumption according to a level of backlight luminance currently employed. The backlight provides light onto one or more LCD panels. Some LCD devices include a single backlight, others include multiple, and the present invention is suitable for use regardless of the number or arrangement of light sources. The backlight may include a lamp, one or more LEDs or any other suitable light emitting technology. Most backlights produce white light, and a few produce non-white light and rely on color conversion in the filtering to produce a suitable gamut.

Other types of variable power display devices may be used. In general, the present invention is independent of any particular display device, any mechanism of light generation for a display device, or any power consumption scheme for a display device, and only assumes that power consumption for the display device 158 may vary with video information. In a specific embodiment, display device 158 can vary power consumption spatially.

Figure 5B:
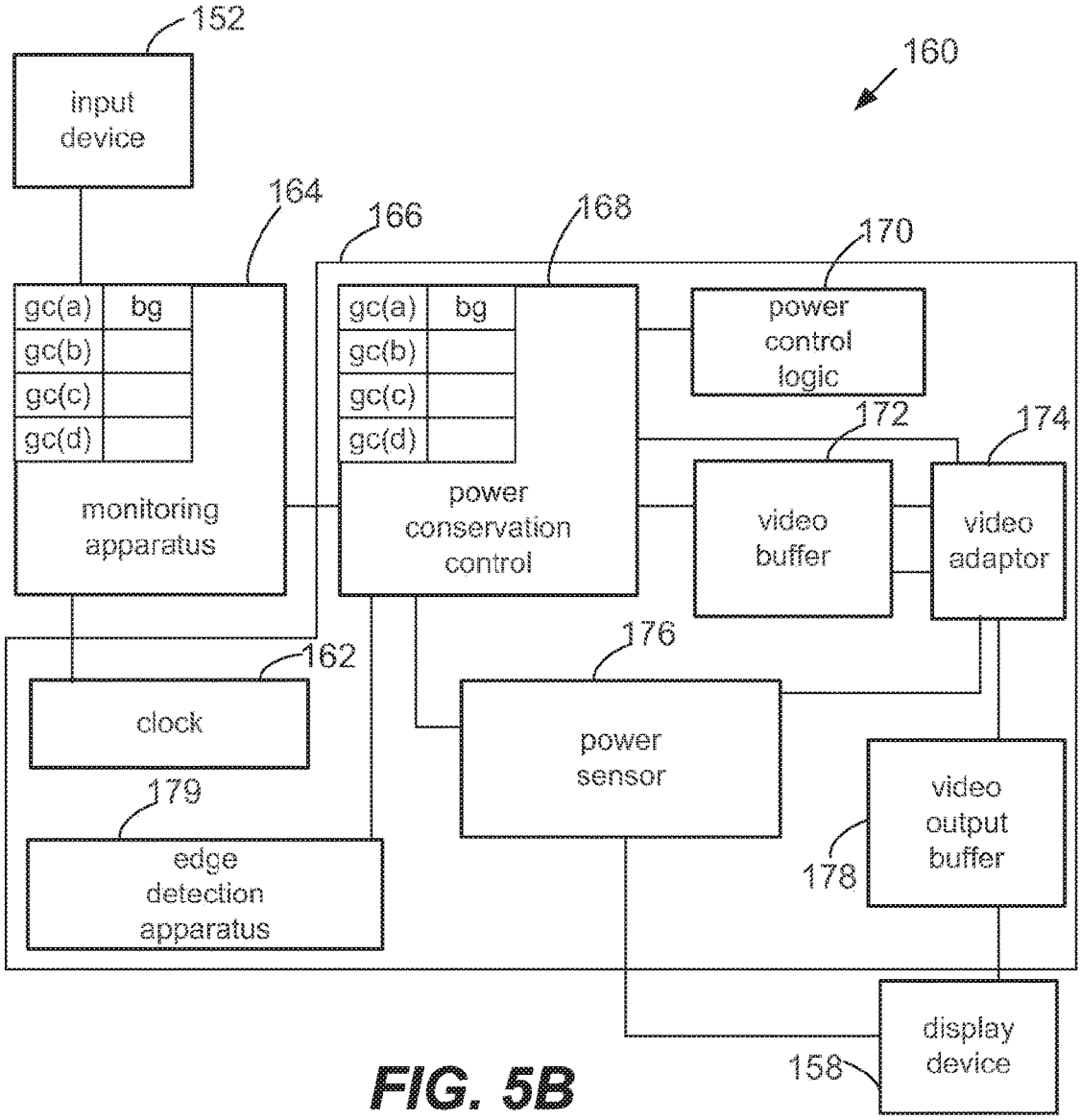
FIG. 5B illustrates a system for reducing power consumed by a display device in accordance with a specific embodiment of the present invention.

FIG. 5B illustrates a system 160 for reducing power consumed by a display device 158 in accordance with a specific embodiment of the present invention. System 160 comprises monitoring apparatus 164 and power conservation apparatus 166. Input device 152 and LCD 158 were described with respect to FIG. 5A. Power conservation apparatus 166 comprises power conservation control 168, clock 162, edge detection apparatus 179, power control logic 170, at least one video buffer 172, video adaptor 174, power sensor 176, and at least one output video buffer 178. Each of the items for system 160 may be implemented in hardware, firmware or software, or a combination thereof. It should be noted that the functionality associated with a particular item may be centralized or distributed, whether locally or remotely.

Monitoring apparatus 164 separates a display area into graphics items. A perimeter for the graphics items may be used in this regard. In this case, display area includes four graphics items and monitoring apparatus 164 stores, or accesses data storage facilities that store, the position and parametric spatial boundaries for graphics items GC(a), GC(b), GC(c), GC(d) and a background. Based on user activity within the display area, monitoring apparatus may designate any one of GC(a), GC(b), GC(c), GC(d) and the background as the active graphics item. The designation is based on user activity in a perimeter of one of the graphics item. The perimeter for this active graphics item then defines an active portion of the display area. The display area outside this perimeter defines inactive portions of the display area. The other graphics items in this inactive area are then designated as inactive. For example, if GC(b) is designated as active, graphics items GC(a), GC(c), GC(d) and the background are designated as inactive. Monitoring apparatus 164 has an input that from input device 152, shape detection apparatus 179 and an input that receives temporal calibration from clock 162 and provides temporal information with regard to user activity. Monitoring apparatus 164 has an output that provides user activity information.

Power conservation apparatus 166 alters video information. Power conservation control 168 has an input that receives user activity information from monitoring apparatus 164, an input from clock 162 that receives temporal information, an input from edge detection apparatus 179 that receives perimeter information if needed, input from sensor 176 that receives an indication of power consumption, and an input from power control logic 170 that receives stored logic according to power conservation techniques described herein. Power conservation control 168 determines how video information is altered to reduce power.

Power conservation control 168 determines an alteration to video information according to stored power conservation logic, and outputs a signal indicative of the alteration. To do so, control 168 coordinates input from monitoring apparatus 164, clock 162, power sensor 176, and power control logic 170. For example, control 168 may implement a luminance reduction scheme for a set of pixels when a graphics item is enlarged. Magnitude and timing of the luminance reduction are determined according to stored instructions acquired from power control logic 170. Input from clock 162 may be used to determine when a threshold activity time has been reached and when to apply other power conservation techniques such as shutting down the display device after a certain period of inactivity.

Power control logic 170 stores data and instructions that allow a processor to implement the techniques described herein. For example, power control logic 170 may include nonvolatile memory that stores a power scheme that applies luminance reductions as described above. In one embodiment, the logic stores instructions that allow the user to set an aggregate luminance reference or a luminance reference for a window amongst a range of possible values. In another embodiment, the logic stores instructions that are implemented by design with no user input. Logic 170 may also store instructions that convert pixel values between color schemes.

Video buffer 172 couples to an input of video adaptor 174 and stores video information. Video buffer 172 stores video information that has been altered. Although video buffer 172 is illustrated as a single unit, it is understood that buffer systems may employ one or more discrete storage items. In particular, different a buffer may be used to store video information without any alterations than a buffer used to store altered video information in between multiple alteration intervals. One or more RAM memory items are suitable for use as video buffer 172.

In one embodiment, power conservation control 168 does not change video information and relies on outside source to do so. In this case, power conservation apparatus 166 includes a video adaptor 174 that receives a signal produced by power conservation control 168 and alters video information based on the signal. Video adaptor 174 creates a set of signals that display pixelated video information for an image. Video adaptor 174 may correspond to a graphics controller, graphics co-processor, graphics accelerator, or other video controller that is commercially available from a variety of vendors. Such controllers are often available as cards that include a separate circuit board with memory and a dedicated processor. Video adaptor 174 may already be implemented within a computer system, as is common in desktop or laptop computer systems. An output line of video adaptor 174 provides the altered video information. In one embodiment, video adaptor 174 converts digital information to analog information. In another embodiment, the data remains digital.

Output video buffer 178 is configured to receive the altered video information from an output of video adaptor 174. One or more RAM memory items are suitable for use as video buffer 172.

A clock 162 provides a temporal reference for user activity. Output lines for clock 162 are coupled to inputs for monitoring apparatus 164 and/or power conservation control 168; and provide a temporal signal to monitoring apparatus 164 and/or power conservation control 168. Most computer systems include a digital clock suitable for use as clock 162.

In one embodiment, system 160 comprises a power sensor 176 that monitors power consumption—both active in the display device and/or as predicted in software. Power sensor 176 may: detect power actively consumed by display device 158, estimate power consumption based on video output from video adaptor 174, track available power resources provided by a battery, and estimate power conservation and savings based on control signals and alterations to video output provided by control 168. Power sensor 176 is coupled to power conservation control 168. In one embodiment, power sensor 176 provides an estimation of power savings and consumption achieved by the present invention. In a specific embodiment, power sensor 176 couples to video adaptor 174 and provides an estimation of power savings and consumption based on the altered video information output from video adaptor 174.

An estimation of power consumption may also be provided without any alterations, which is useful for comparative purposes and quantifying conservation. An output line of power sensor 176 couples to an input of power conservation control 168 and allows control 168 to alter video output based on one or more of: power actively consumed by LCD 158, video output from video adaptor 174, and available power provided by a battery, all of which can be combined with estimated power conservation for alterations to video information determined by control 168.

In one embodiment, system 160 also employs an edge detection apparatus 179 that facilitates spatial mapping of graphics items. Thus, edge detection apparatus 179 may be called upon by monitoring apparatus 164 to produce perimeter information for graphics items that do not readily include characteristic perimeter information in their bitmap. Edge detection apparatus 179 then probes video information for a graphics item (such as that included in a bitmap for the graphics item), builds a perimeter or shape based on the video information, and outputs the perimeter information for the graphics item to one of monitoring apparatus 164, power conservation control 168 or buffer 172 for storage therein.

In one embodiment, power conservation as described herein is implemented without user control. In another embodiment, a computer system provides a user the ability to turn on/off power conservation or tailor the power conservation to personal preferences.

The present invention also relates to controls for implementing power conservation. Graphics-based user interfaces employ what are referred to as graphics "controls". A graphics control is a discrete video object, for display by a display device, which can be manipulated by a user to alter one or more graphics outputs or effects and/or to initiate an action in an associated application program. The graphics control often includes its own bitmap comprising an array of pixel values.

Although the present invention has been described so far with respect to alterations in video information and power conservation according to a RGB color scheme, video information alterations may also be applied in other color schemes, as one of skill in the art will appreciate. An HSL color scheme characterizes video output according to a wavelength or color (hue), degree of purity of the color—or degree of separation from gray having the same color (saturation), and degree of brightness for the color ranging from black to white (luminance). Cyan, magenta, yellow and black (CMYK) is another color scheme regularly used to characterize video output from display device according to combinations of cyan, magenta, yellow and black values. In general, power conservation techniques described herein may be implemented via regardless of the color scheme used to store the video information or employed by a graphics-based user interface, video controller or display device. Alterations and video conservation as described herein may also apply to black and white video output.

Translation between the color schemes is well known to one of skill in the art. Although the present invention has been described so far with respect to video information alterations in an RGB scheme, one of skill in the art will appreciate that power conservation techniques described herein may be programmed or stored according to one color scheme, and output according to another color scheme for the display device. For example, video data manipulation techniques described herein may be programmed or stored in an HSL scheme, and then converted to and implemented on an RGB based display device.

Figure 6:
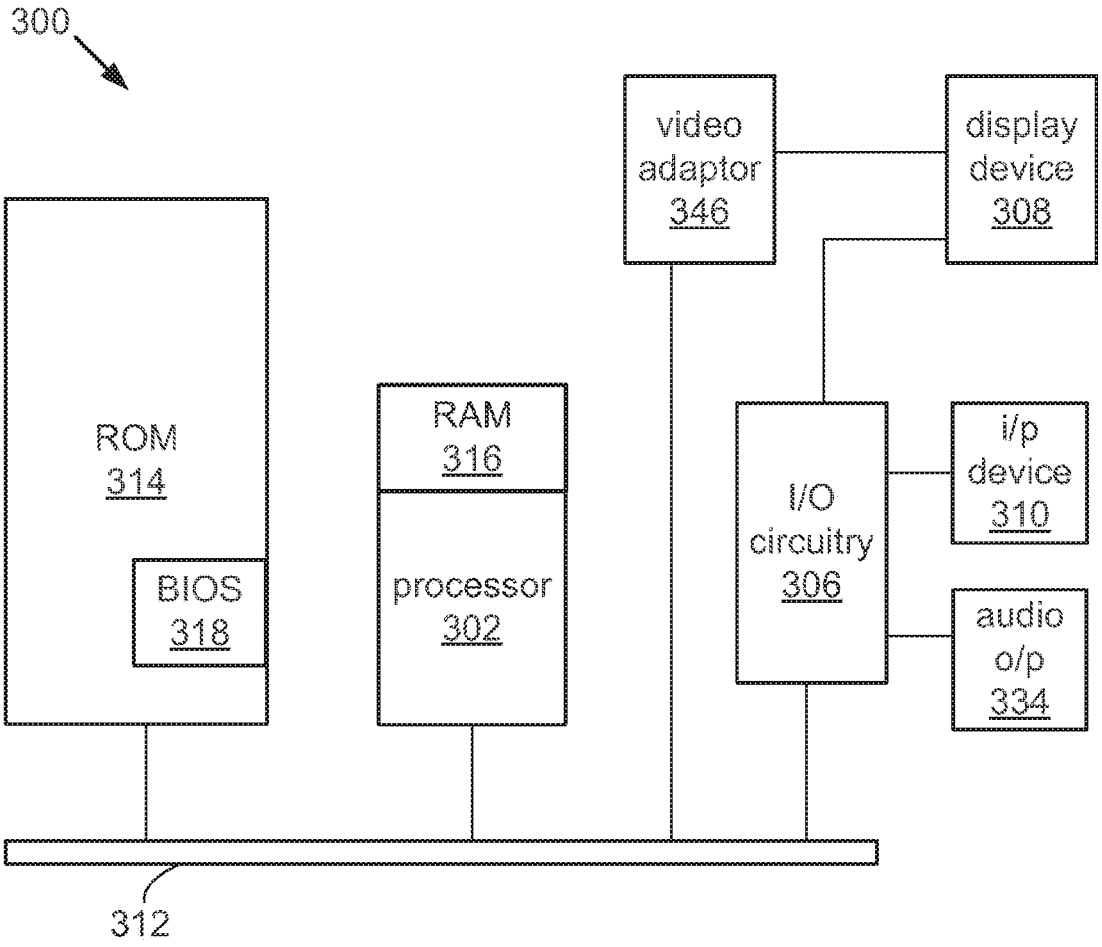
FIG. 6 illustrates an exemplary computer system suitable for implementing the invention.

The present invention finds use with computer systems such as desktop and laptop computers, personal digital assistants (PDAs), cellular telephones, digital cameras, portable computer systems, and the like. FIG. 6 schematically illustrates an exemplary general-purpose computer system 300 suitable for implementing the present invention.

Computer system 300 comprises a processor, or CPU, 302, one or more memories 314 and 316, input/output (I/O) circuitry 306, display device 308, input device 310, and system bus 312. System bus 312 permits digital communication between system processor 302 and ROM 314, as well as permits communication between other items within system 300 and processor 302 and/or ROM 314.

System 300 memory includes read only memory (ROM) 314 and random access memory (RAM) 316. Other memories may be included, such as another RAM module that separately couples to bus 312. ROM 314 stores a basic input/output system 318 (BIOS), containing basic routines that help to transfer information between elements within computer system 300, such as during start-up. Computer system 300 may also include a hard disk drive and an optical disk drive, for example. The optical disk drive reads from and may write to a CD-ROM disk or other optical media. The drives and their associated computer-readable media provide non-volatile storage for system 300. A number of program modules may be stored in the drives, ROM 314, and/or RAM 316, including an operating system, one or more application programs, other program modules, and program data. Although data storage above refers to a hard disk and optical disk, those skilled in the art will appreciate that other types of storage are suitable for use with a computer system, such as magnetic cassettes, flash memory cards, USB memory sticks, and the like. In addition, not all computer systems, such as PDAs and other portable devices may include multiple external memory options.

Processor 302 is a commercially available microprocessor such as one of the Intel or Motorola family of chips, or another suitable commercially available processor. Processor 302 digitally communicates with ROM 314 via system bus 312, which may comprise a data bus, control bus, and address bus for communication between processor 302 and memory 314. CPU 302 is also coupled to the I/O circuitry 306 by system bus 312 to permit data transfers with peripheral devices.

I/O circuitry 306 provides an interface between CPU 302 and such peripheral devices as display device 308, input device 310, audio output 334 and/or any other I/O device. For example, a mouse used as input device 310 may digitally communicate with processor 302 through a serial port 306 that is coupled to system bus 312. Other interfaces, such as a game port, a universal serial bus (USB) or fire wire, may also provide digital communication between a peripheral device and processor 302. I/O circuitry 306 may also include latches, registers and direct memory access (DMA) controllers employed for interface with peripheral and other devices. Audio output 334 may comprise one or more speakers employed by a headphone or speaker system.

Display device 308 outputs video information—both unaltered and altered—including graphics items, backgrounds, graphics controls such as those described herein, graphics-based user interfaces, and other visual representations of data. For example, display device 308 may comprise a cathode ray tube (CRT), liquid crystal display (LCD), organic light emitting diode (OLED), or plasma display, of the types commercially available from a variety of manufacturers. Display device 308 may also comprise one or more optical modulation devices, or the like, used in projecting an image. Projection display devices that project an image onto a receiving surface are becoming more popular, less expensive, more compact; and may employ one or more optical modulation technologies as well as a wide variety of individual designs. Common optical modulation devices include those employing liquid crystal display (LCD) technology and digital mirror device (DMD) technology. When used as a display device for a computer, these projection devices provide the potential for a much larger image size and user interface.

Display device 308 may also digitally communicate with system bus 306 via a separate video interface, such as a video adapter 346. Video adapter 346 may be responsible for assisting processor 302 with video graphics processing including power conservation alterations described herein. Video adapter 346 may be a separate graphics card or graphics processor available from a variety of vendors that are well known in the art.

Input device 310 allows a user to enter commands and information into the computer system 300, and may comprise a keyboard, a mouse, a position-sensing pad on a laptop computer, a stylus working in cooperation with a position-sensing display on a PDA, or the like. Other input devices may include a remote control (for a projector), microphone, joystick, game pad, scanner, or the like. As used herein, input device refers to any mechanism or device for entering data and/or pointing to a particular location on an image of a computer display. Input as described herein may also come through intermediary devices. For example, a remote control may communicate directly with processor 302, or through an intermediary processor included in another device such as a hybrid entertainment device such as a set-top box or projector. The user may then input information to computer system 300 using an infrared remote control device that communicates first with the intermediary device, and then to processor 302.

In one embodiment, a graphics-based user interface implemented by computer system 300 displays a graphics control. To display a power conservation graphics control, processor 302 issues an appropriate command, followed by an identification of data that is to be used to construct the graphics control. Such data may include a number of power conservation control tools that allow a user to change how video data is altered and power is conserved. ROM 314 also stores a number power conservation commands and instructions for implementing the techniques described herein. In one embodiment, the present invention is practiced in the context of an application program that runs on an operating system implemented by computer system 300 or in combination with other program modules on computer system 300.

The present invention may be implemented on a range of computer systems. In addition to personal computers such as desktop computers and laptop computers, a variety of other computer systems and computer devices employing a digital processor, memory and a display device may implement the present invention. Handheld computers and other small portable digital devices such as cell phones and digital cameras are increasingly integrating video display and computer functionality. One current trend is hybrid entertainment devices that integrate the functionality of computer systems, audio devices, and televisions. Any of these devices may employ and benefit from the power conservation methods and systems described herein. The scope of digital computer systems is evolving and creating new devices that may employ the present invention. In general, any digital device employing an output display device that varies output power with video content may benefit from the present invention. Moreover, those skilled in the art will appreciate that the invention may be practiced with other computer system configurations, multiple display device systems, multi-processor systems, microprocessor-based or programmable consumer electronics, minicomputers, mainframe computers, and the like.

In some cases, control menus and toggles, a clock, and other small and frequently used graphics items may include video information that is not altered or altered less while video information for the background and all programs are altered to conserve power. Avoiding alteration maintains a person's ability to detect and use these elements.

The present invention is particularly useful to portable computing devices run with battery power. Most handheld devices are designed to rely on battery power. In addition, although the present invention has been discussed with respect to reduced power consumption, energy and power are relatively interchangeable in a discussion of the benefits of conservation.

Embodiments of the present invention further relate to computer readable media that include program instructions for performing power conservation techniques described herein. The media and program instructions may be those specially designed and constructed for the purposes of the present invention, or any kind well known and available to those having skill in the computer software arts. Examples of computer-readable media include, but are not limited to, magnetic media such as hard disks, semiconductor memory, optical media such as CD-ROM disks; magneto-optical media such as optical disks; and hardware devices that are specially configured to store program instructions, such as read-only memory devices (ROM), flash memory devices, EEPROMs, EPROMs, etc. and random access memory (RAM). Examples of program instructions include both machine code, such as produced by a compiler, and files containing higher-level code that may be executed by the computer using an interpreter.

Graphics controls and graphics-based user interfaces such as those described herein may be implemented using a number of computer languages and in a number of programming environments. One suitable language is Java, available from Sun Microsystems of Sunnyvale, Calif. Another suitable programming environment is the Microsoft Windows® programming environment, which provides a series of operating systems suitable for implementing the present invention both on laptop computers and handheld computers.

Although the foregoing invention has been described in some detail for purposes of clarity of understanding, those skilled in the art will recognize that various modifications may be made within the scope of the appended claims. The invention is, therefore, not limited to the specific features and embodiments described herein and claimed in any of its forms or modifications within the scope of the appended claims.

What is claimed is:

1. A portable communication device comprising:

a display including an organic light emitting diode display; and at least one processor configured to:

receive a request to execute an application, identify color information corresponding to an image including a graphical user interface with respect to the application, the color information corresponding to at least one of a red pixel, a green pixel, or a blue pixel in relation with displaying of the image via the display, determine whether the color information falls into a specified value, adjust the color information based at least in part on a result of the determination, and display the image according to the adjusted color information via the display such that a power consumption required to display the image is less than a power consumption required without the adjusting, wherein the specified value is determined based on a size of the graphical user interface.

2. The portable communication device of claim 1, wherein the at least one processor is further configured to:

perform the identifying of the color information using the image including a background image and the graphical user interface with respect to the application.

3. The portable communication device of claim 1, wherein the at least one processor is further configured to:

determine, as at least part of the adjusting, luminance corresponding to the image using the color information.

4. The portable communication device of claim 3, wherein the at least one processor is further configured to:

decrease, as at least part of the adjusting, the color information based at least in part on a determination that the luminance corresponding to the image is higher than a specified luminance.

5. The portable communication device of claim 1, wherein the at least one processor is further configured to:

decrease, as at least part of the adjusting, electrical current to be supplied to one or more light emitting elements included in the display.

6. The portable communication device of claim 1, wherein the at least one processor is further configured to:

perform the adjusting in response to receiving a user input to increase a size of the graphical user interface.

7. The portable communication device of claim 6, wherein the at least one processor is further configured to:

detect, as at least part of the receiving of the user input, a position of the user input on the display.

8. A portable communication device comprising:

a display including an organic light emitting diode display; and at least one processor configured to:

receive a request to execute an application, identify color information corresponding to a screen including a graphical user interface with respect to the application, the color information corresponding to at least one of a red pixel, a green pixel, or a blue pixel in relation with displaying of the screen via the display, determine whether the color information falls into a specified value, adjust the color information based at least in part on a result of the determination, and display the screen according to the adjusted color information via the display such that luminance required to present the application is less than luminance required without the adjusting, wherein the specified value is determined based on a size of the graphical user interface.

9. The portable communication device of claim 8, wherein the at least one processor is further configured to:

perform the identifying of the color information using the screen including a background image and the graphical user interface with respect to the application.

10. The portable communication device of claim 8, wherein the at least one processor is further configured to:

determine, as at least part of the adjusting, aggregate luminance corresponding to the screen using the color information.

11. The portable communication device of claim 10, wherein the at least one processor is further configured to:

decrease, as at least part of the adjusting, the color information based at least in part on a determination that the aggregate luminance corresponding to the screen is above a specified luminance.

12. The portable communication device of claim 8, wherein the at least one processor is further configured to:

decrease, as at least part of the adjusting, electrical current to be supplied to one or more light emitting elements included in the display.

13. The portable communication device of claim 8, wherein the at least one processor is further configured to:

perform the adjusting in response to receiving a user input to increase a size of the graphical user interface.

14. The portable communication device of claim 13, wherein the at least one processor is further configured to:

detect, as at least part of the receiving of the user input, a position of the user input on the display.

15. A non-transitory machine-readable storage device storing instructions that, when executed by one or more processors, cause the one or more processors to perform operations comprising:

receiving a request to execute an application at a display including an organic light emitting diode (OLED) display;

identifying color information corresponding to a screen including a graphical user interface with respect to the application, the color information corresponding to at least one of a red pixel, a green pixel, or a blue pixel in relation with displaying of the screen via the OLED display;

determining whether the color information falls into a specified value;

adjusting the color information based at least in part on a result of the determination; and displaying the screen according to the adjusted color information via the OLED display such that luminance required to present the application is less than luminance required without the adjusting, wherein the specified value is determined based on a size of the graphical user interface.

16. The non-transitory machine-readable storage device of claim 15, wherein the screen includes a background image and the graphical user interface with respect to the application.

17. The non-transitory machine-readable storage device of claim 15, wherein the adjusting comprises:

determining aggregate luminance corresponding to the screen using the color information.

18. The non-transitory machine-readable storage device of claim 17, wherein the adjusting comprises:

decreasing the color information based at least in part on a determination that the aggregate luminance corresponding to the screen is above a specified luminance.

19. The non-transitory machine-readable storage device of claim 15, wherein the adjusting comprises:

decreasing electrical current to be supplied to one or more light emitting elements included in the OLED display.

20. The non-transitory machine-readable storage device of claim 15, wherein the adjusting comprises:

detecting a user input to increase a size of the graphical user interface.

* * * * *